US010640947B1

(12) United States Patent
Jackson et al.

(10) Patent No.: US 10,640,947 B1
(45) Date of Patent: May 5, 2020

(54) IN-GROUND SWIMMING POOL FORM SYSTEM INCLUDING SUPPORT MEMBERS AND RELATED METHODS

(71) Applicant: JACKSON POOLS, INC., Fort Myers, FL (US)

(72) Inventors: Chad Jackson, Fort Myers, FL (US); Richard Cox, Fort Myers, FL (US)

(73) Assignee: Jackson Pools, Inc., Fort Myers, FL (US)

( * ) Notice: Subject to any disclaimer, the term of this patent is extended or adjusted under 35 U.S.C. 154(b) by 0 days.

(21) Appl. No.: 16/351,884

(22) Filed: Mar. 13, 2019

(51) Int. Cl.

| | |
|---|---|
| ***E04B 1/00*** | (2006.01) |
| ***E02D 29/02*** | (2006.01) |
| ***E04B 2/86*** | (2006.01) |
| ***E04H 4/00*** | (2006.01) |

(52) U.S. Cl.
CPC ..... *E02D 29/0233* (2013.01); *E04B 2/8635* (2013.01); *E04H 4/0081* (2013.01)

(58) Field of Classification Search
CPC ..... E04G 17/12; E04G 13/00; E04G 11/062; E04B 2/8635; E04B 1/161; E02D 29/0233; E04H 4/0081
See application file for complete search history.

(56) References Cited

U.S. PATENT DOCUMENTS 1,067,420 A 7/1913 Forbis
1,637,998 A * 8/1927 Heltzel ..... E01C 19/506 249/5
1,816,921 A 8/1931 Urschel
2,180,842 A 11/1939 Winding
2,614,311 A 10/1952 Shook
2,635,320 A 4/1953 Ornitz
2,973,567 A 3/1961 Brow et al.
3,195,852 A * 7/1965 Lundell ..... E04G 13/00 249/34
3,207,465 A 9/1965 Papin
3,317,925 A 5/1967 Vance
3,610,564 A 10/1971 Mattingly
3,662,985 A 5/1972 Parker
(Continued)

OTHER PUBLICATIONS

Frank Wall Enterprises, LLC; "What is the Aquaform Difference?;" Website: www.frankwall.com/aquaforms/, pp. 1-18; retrieved Feb. 18, 2019.

(Continued)

*Primary Examiner* — Carib A Oquendo
(74) *Attorney, Agent, or Firm* — Allen, Dyer, Doppelt, + Gilchrist, P.A. Attorneys at Law

(57) ABSTRACT

A form system for an in-ground swimming pool may include inner and outer form panels to be coupled in side-by-side relation. Support members may be for coupling the outer form panels in spaced relation from the inner form panels to define a wall space therebetween. Each of the support members may include a base member to be carried by respective inner and outer form panels over the wall space, an arm extending from the base member for coupling to the respective outer form panel, and a wall support member for coupling to the respective inner form panel. The wall support member may include a wall support lip extending from a wall support body for engaging the respective inner form panel so that the respective inner form panel is suspended from the wall support lip.

20 Claims, 21 Drawing Sheets

(56) References Cited

U.S. PATENT DOCUMENTS

| | | | | | |
|---|---|---|---|---|---|
| 3,739,539 | A | | 6/1973 | Posnick | |
| 3,748,810 | A | * | 7/1973 | Mattingly | E04H 4/0081 52/741.12 |
| 3,906,688 | A | | 9/1975 | Witte | |
| 4,066,237 | A | | 1/1978 | Bentz | |
| 4,090,266 | A | | 5/1978 | Price | |
| 4,263,759 | A | | 4/1981 | Miller | |
| 4,291,858 | A | | 9/1981 | Nesmith | |
| 4,339,106 | A | * | 7/1982 | Navarro | E04G 17/12 249/219.1 |
| 4,443,982 | A | | 4/1984 | Dalbanne | |
| 4,494,725 | A | | 1/1985 | Sims | |
| 4,630,797 | A | * | 12/1986 | Bomford | E04G 17/12 249/20 |
| 4,915,345 | A | | 4/1990 | Lehmann | |
| 5,038,541 | A | | 8/1991 | Gibbar, Jr. | |
| 5,156,753 | A | | 10/1992 | Speidel | |
| 5,192,162 | A | * | 3/1993 | McKinnon | E04H 4/005 4/506 |
| 5,330,151 | A | * | 7/1994 | Boyack | E04H 4/0081 249/83 |
| 5,400,555 | A | | 3/1995 | Kantor | |
| 5,547,163 | A | | 8/1996 | Lack | |
| 5,782,050 | A | | 7/1998 | Boeshart | |
| 6,173,937 | B1 | | 1/2001 | Cottongim | |
| 6,390,440 | B1 | | 5/2002 | Morin | |
| 6,412,247 | B1 | | 7/2002 | Menchetti et al. | |
| 7,229,062 | B1 | | 6/2007 | Rascon | |
| 7,255,319 | B2 | * | 8/2007 | Albano | E04G 13/00 249/34 |
| 7,841,576 | B2 | * | 11/2010 | Miller | E01C 19/502 249/208 |
| 8,261,503 | B2 | | 9/2012 | Meyer | |
| 8,555,583 | B2 | | 10/2013 | Ciuperca | |
| 2002/0178676 | A1 | | 12/2002 | Yost et al. | |
| 2003/0101670 | A1 | | 6/2003 | Gustin | |
| 2006/0137273 | A1 | | 6/2006 | Baker et al. | |
| 2006/0277851 | A1 | | 12/2006 | Hudon et al. | |
| 2011/0131911 | A1 | | 6/2011 | Mcdonagh | |
| 2011/0265414 | A1 | | 11/2011 | Ciccarelli | |
| 2012/0073229 | A1 | | 3/2012 | Castonguay et al. | |
| 2014/0157704 | A1 | | 6/2014 | Mcdonagh | |
| 2015/0159339 | A1 | | 6/2015 | Castonguay et al. | |

OTHER PUBLICATIONS

Jackson et al.; U.S. Appl. No. 15/994,449, filed May 31, 2018.

* cited by examiner

IN-GROUND SWIMMING POOL FORM SYSTEM INCLUDING SUPPORT MEMBERS AND RELATED METHODS

TECHNICAL FIELD

The present embodiments are directed to the field of swimming pools, and more particularly, to swimming pool construction and related methods.

BACKGROUND

A swimming pool is a relatively popular structure for swimming or other leisure activities. One type of swimming pool is an in-ground swimming pool. In one type of in-ground swimming pool, walls, typically metal or plastic are installed into an excavated area. The walls each typically have a same height. In other words, the walls do not vary in height to extend to a "deep end" depth. Foam padding may be placed over the walls to define the inside walls of the swimming pool. Sand may be positioned and smoothed to define the floor of the pool. A liner, typically vinyl, is installed over the foam or inside walls of the pool, and floor of the pool over the sand.

Another type of in-ground swimming pool includes the use of cement for forming the walls and floor. More particularly, a minimal wood frame is constructed within an excavated area. Metal or steel rebar, for example, in an interlaced or wire mesh fashion, is used to define the walls and floor of the pool (i.e., define the form). Gunite, shotcrete, or sprayed concrete is sprayed into form or floor and walls and permitted to harden. A pool finish is then added, for example, sprayed, over the sprayed concrete.

SUMMARY

A form system for an in-ground swimming pool may include a plurality of outer form panels to be coupled in side-by-side relation within an area of excavated ground corresponding to a desired in-ground swimming pool shape. The form system may also include a plurality of inner form panels to be coupled in side-by-side relation and a plurality of support members to couple the plurality of outer form panels in spaced relation from the plurality of inner form panels to define a wall space therebetween. Each of the plurality of support members may include a base member to be carried by respective ones of the outer and inner form panels over the wall space and an arm extending from the base member for coupling to the respective outer form panel. Each of the plurality of support members may also include a wall support member for coupling to the respective inner form panel and that includes a wall support body carried by the base member and a wall support lip extending from the wall support body, the wall support lip for engaging the respective inner form panel so that the respective inner form panel is suspended from the wall support lip.

Each of the plurality of outer form panels may include a wall panel and a support member bracket carried by the wall panel and configured to couple to a respective arm. The support member bracket may have a passageway therein to slidably receive the arm, for example.

Each of the plurality of inner form panels may include a wall panel and at least one longitudinal rib carried by the wall panel for engaging the wall support lip. The at least one longitudinal rib may be carried by an upper end of the wall panel adjacent the support member, for example.

At least one support member of the plurality thereof may include a form stop carried by the base member between the wall support member and the arm. The form stop may include a sleeve slidable along the base member for engaging the respective inner form panel within the wall space, for example.

The wall support member may be movable along the base member. The plurality of inner form panels may have a height that is shorter than a height of the plurality of outer form panels, for example.

The wall support lip may extend from the wall support member for engaging the respective inner form panel adjacent an upper end thereof. The form system may also include a plurality of snap ties to extend across the wall space and couple the plurality of inner and outer form panels, for example.

A method aspect is directed to a method of constructing an in-ground swimming pool. The method may include positioning a plurality of outer form panels in side-by-side relation within an excavated area of ground corresponding to a desired in-ground swimming pool shape and positioning a plurality of inner form panels in side-by-side relation. The method may further include coupling a plurality of support members to the plurality of outer form panels in spaced relation from the plurality of inner form panels to define a wall space therebetween. Each of the plurality of support members may be coupled so that a base member thereof is carried by respective ones of the outer and inner form panels over the wall space, so that an arm thereof extends from the base member and couples to the respective outer form panel, and so that a wall support lip extending from a support member body carried by the base member, engages the respective inner form panel to suspend the respective inner form panel from the wall support lip.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notation is used to refer to like elements in different embodiments.

Figure 1:
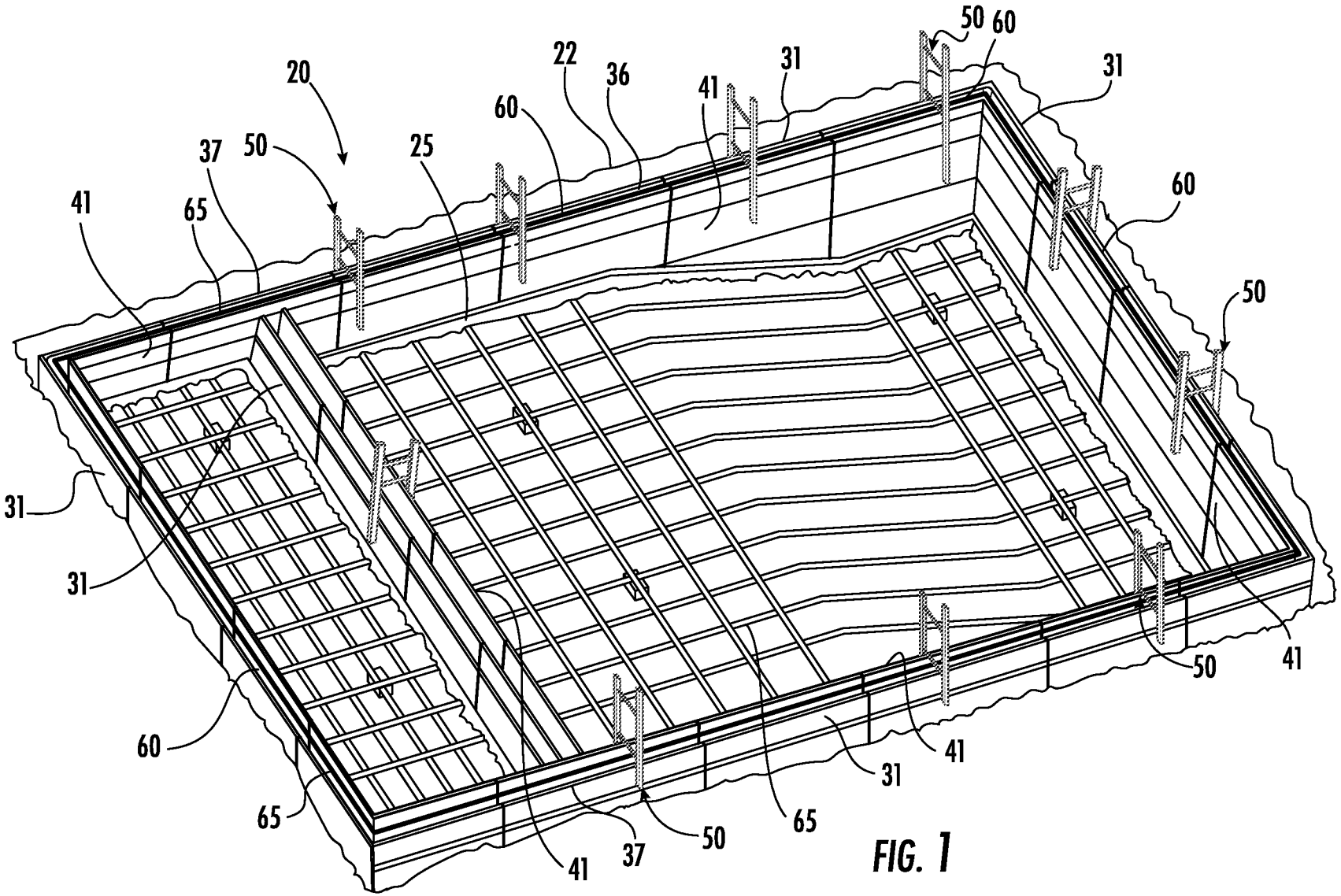
FIG. 1 is a schematic diagram of an in-ground swimming pool including a form system according to an embodiment.
Figure 2:
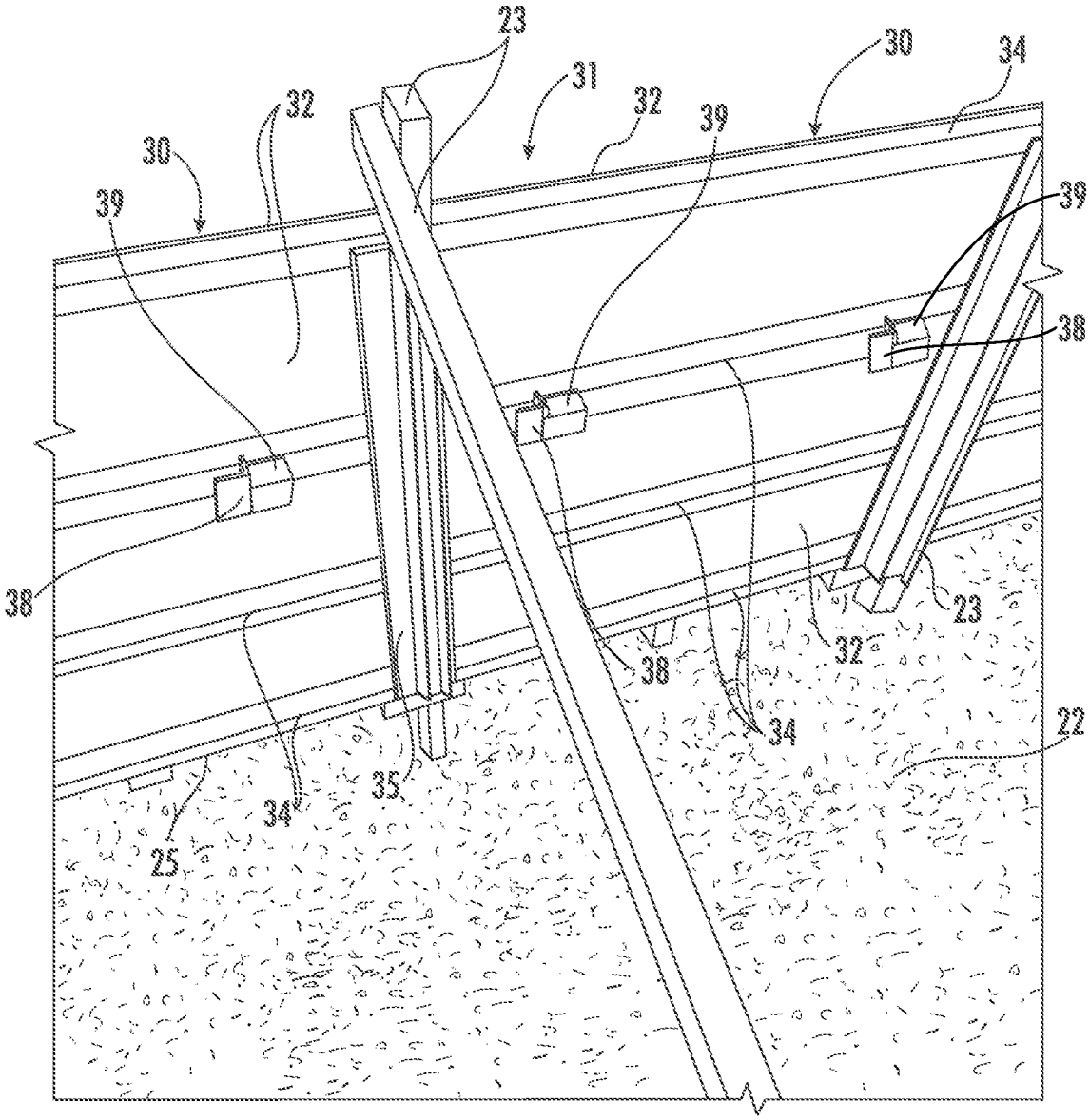
FIG. 2 is a perspective view of outer form panels according to an embodiment.
Figure 13A:
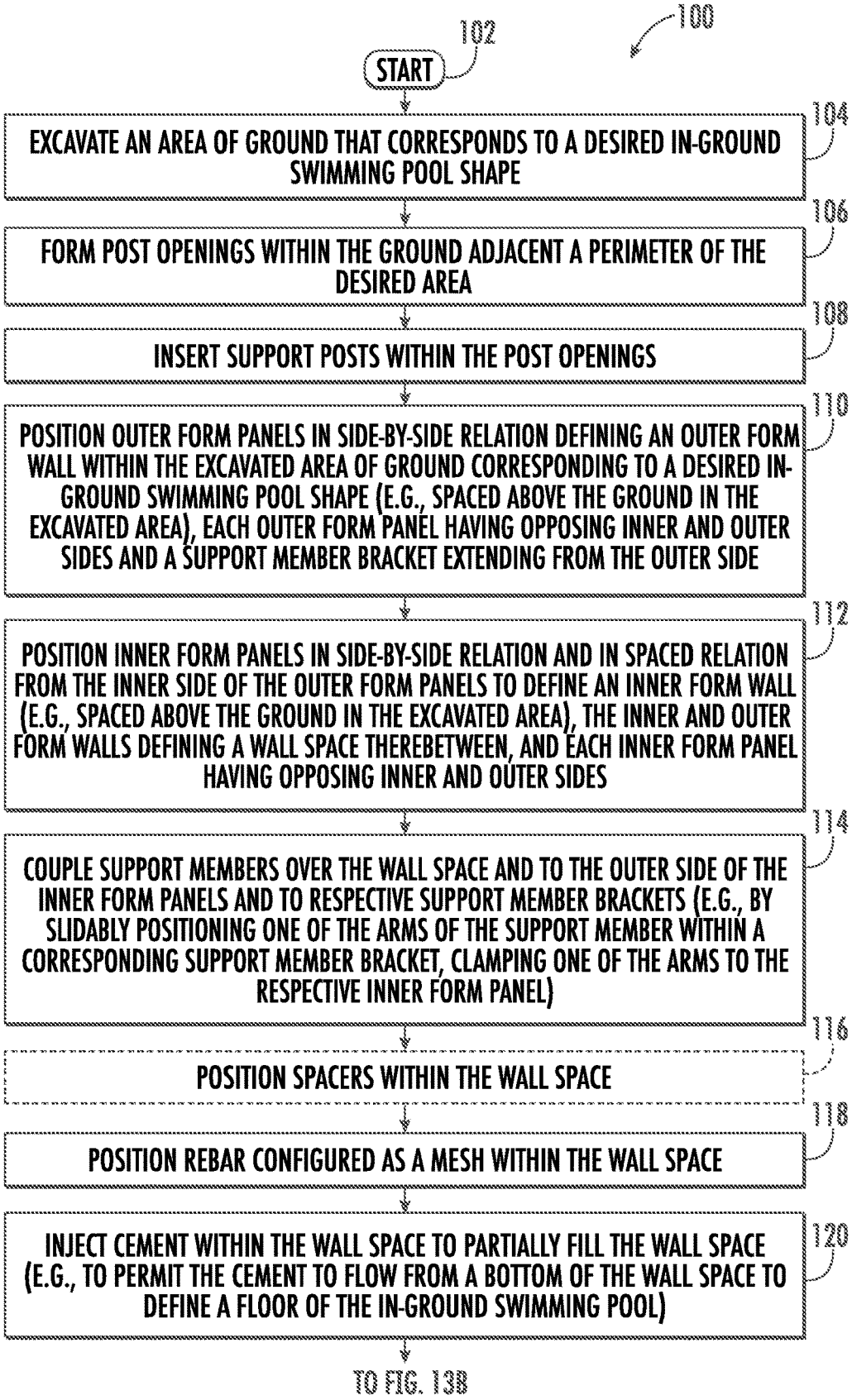
FIG. 13*a* is a flow diagram of a method of constructing an in-ground swimming pool using a form system according to an embodiment.

Referring initially to FIGS. 1-2, and the flowchart 100 in FIG. 13A, beginning at Block 102, a method of constructing an in-ground swimming pool 20 is described. At Block 104, the method includes excavating an area of ground 22 that corresponds to a desired in-ground swimming pool shape. The depth of the excavated area of ground 22 may correspond to a desired depth of the in-ground swimming pool. For example, a spa or sun-shelf may have a more shallow excavated depth, while a "deep-end" may have a corresponding deeper excavated depth. Those skilled in the art will appreciate that similar to the excavated area or plan, the depth may be excavated to be slightly deeper than the desired depths, for example, to permit plumbing, rebar, and/or other in-ground swimming pool components within the excavated area.

At Block 106, the method includes forming post openings within the ground 22 adjacent a perimeter of the desired area and inserting support posts 23 (e.g., vertically) within the post openings (Block 108). As will be appreciated by those skilled in the art, the area of ground 22 is excavated to be slightly larger than the desired size of the in-ground swimming pools so as to permit the support posts 23 to be positioned therein.

The support posts 23 may be wood, for example, 2×4. The support posts 23 may be another type or size of material.

The method further includes positioning outer form panels 30 in side-by-side relation to define an outer form wall 31 (Block 110). More particularly, each outer form panel 30 includes a smooth rigid panel 32 defining the inside of the outer form panel and spaced apart ribs 34 laterally coupled along a length of the smooth rigid panel defining the outer side of the outer form panel. The smooth rigid panel 32 and spaced apart ribs 34 may be steel, for example, galvanized steel. The smooth rigid panel 32 and spaced apart ribs 34 may each be another or different materials. Each of the spaced apart ribs 34 is illustratively in the form of a square tube, for example, having a 2"×2" size. Each of the spaced apart ribs 34 may be a different size, and the amount of spaced apart ribs may be based upon the size and shape of each outer form panel 30. For example, longer or deeper (e.g., for deeper excavated areas of the ground 22) outer form panels 30 may have four spaced apart ribs 34, while outer form panels for more shallow excavated areas, such as, for example, spas or sun-shelves, may have less than four spaced apart ribs.

Angled brackets 35 are coupled to the spaced apart ribs 34 and have an L-shape. The positioning of the outer form panels 30 in side-by-side relation to define the outer form wall 31 includes coupling, for example, using fasteners, each outer form panel to respective support posts 23. As will be appreciated by those skilled in the art the angled brackets 35 are positioned from the ends of each outer form panel so that adjacent panels are coupled to a support post 23 without spacing therebetween (e.g., sized for a 2"×4" support post).

The outer form panels 30 are coupled to the support posts 23 so that the outer form panels 30 are spaced above the excavated ground 22. In other words, there is a space 25 between the excavated ground and the bottom of each outer form panel 30. In some embodiments, fasteners, for example, threaded fasteners and nuts, may be also used to further secure adjacent outer form panels 30.

Figure 3:
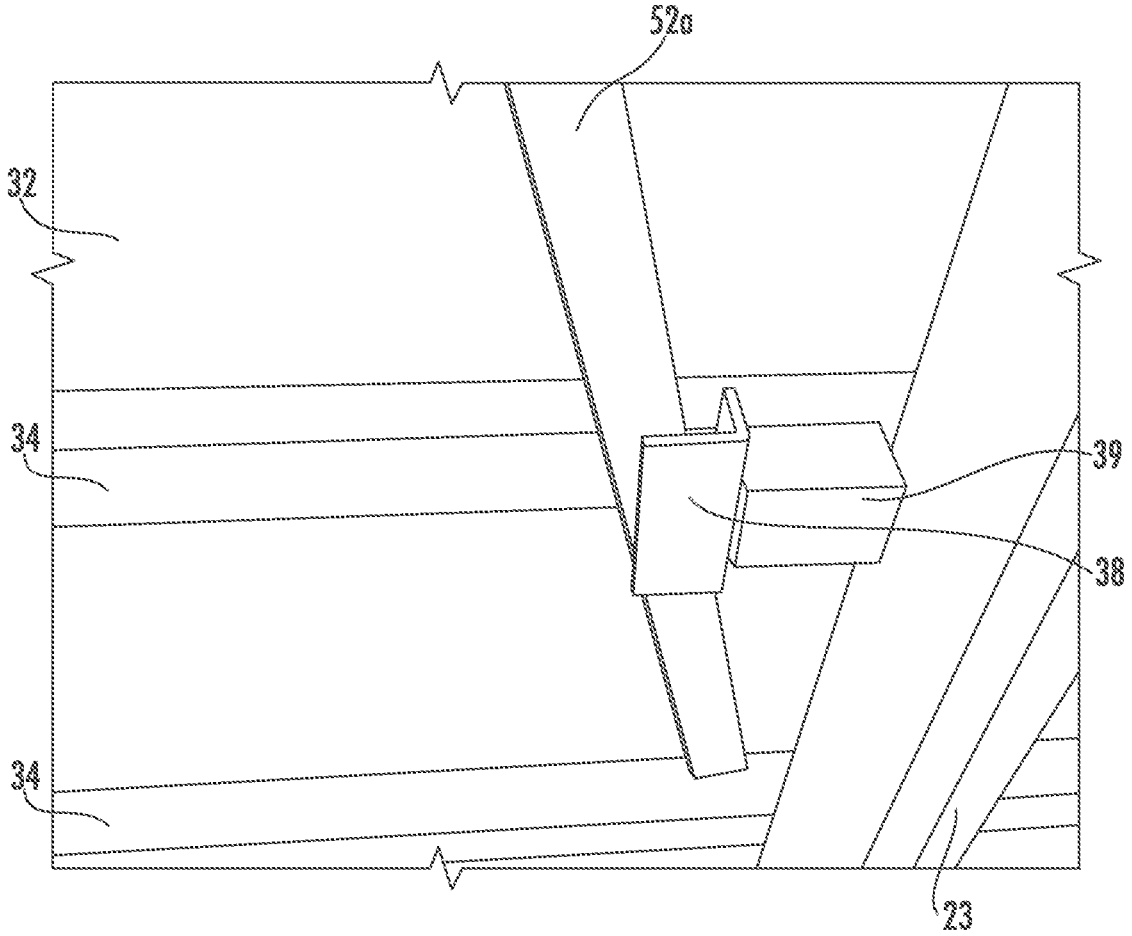
FIG. 3 is an enlarged perspective view of a portion of an outer form panel according to an embodiment.
Figure 4:
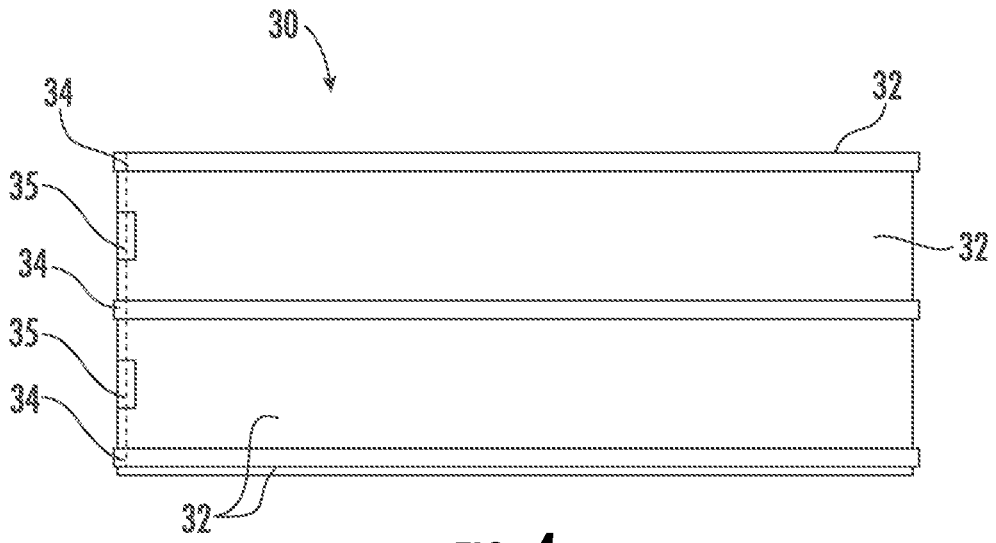
FIG. 4 is a schematic diagram of an exemplary outer form panel according to an embodiment.
Figure 5:
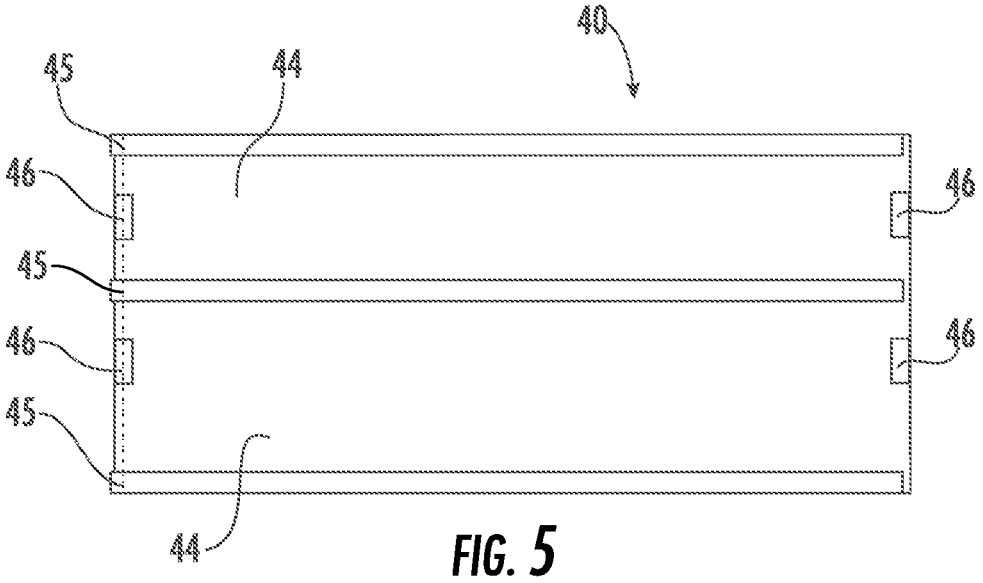
FIG. 5 is a schematic diagram of an exemplary inner form panel according to an embodiment.
Figure 6:
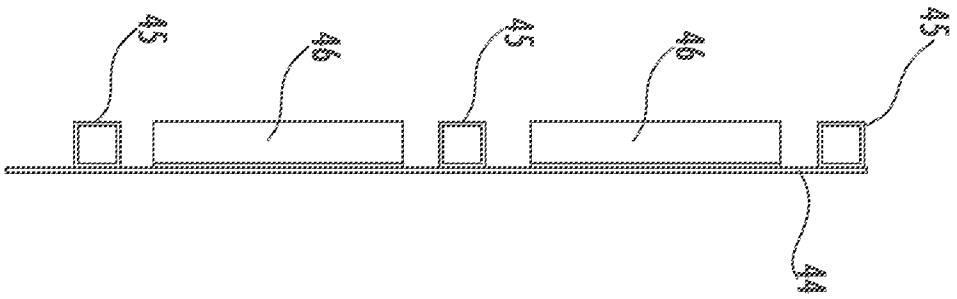
FIG. 6 is another schematic diagram of an exemplary inner form panel according to an embodiment.
Figure 7:
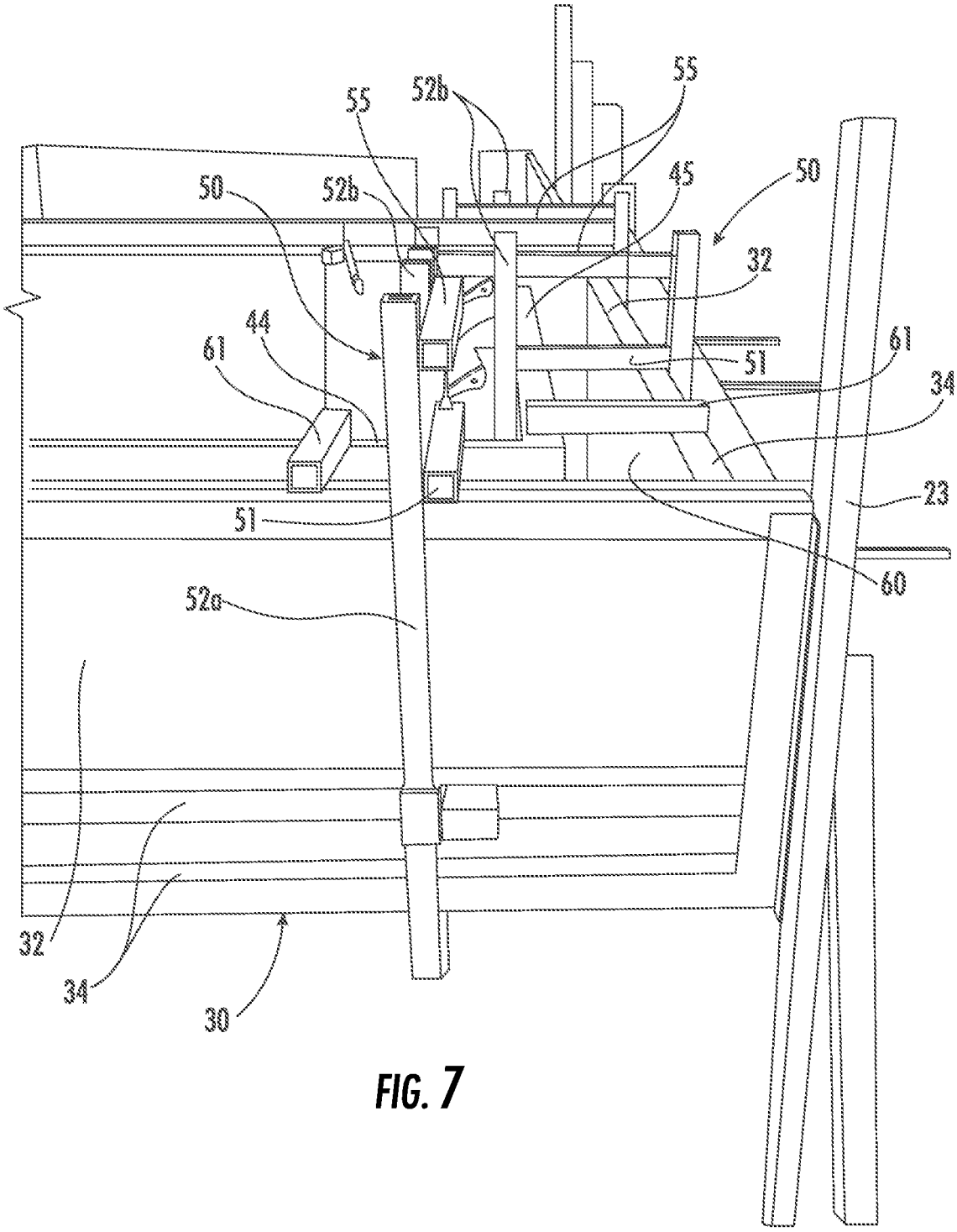
FIG. 7 is a perspective view of portions of a form system according to an embodiment.
Figure 8:
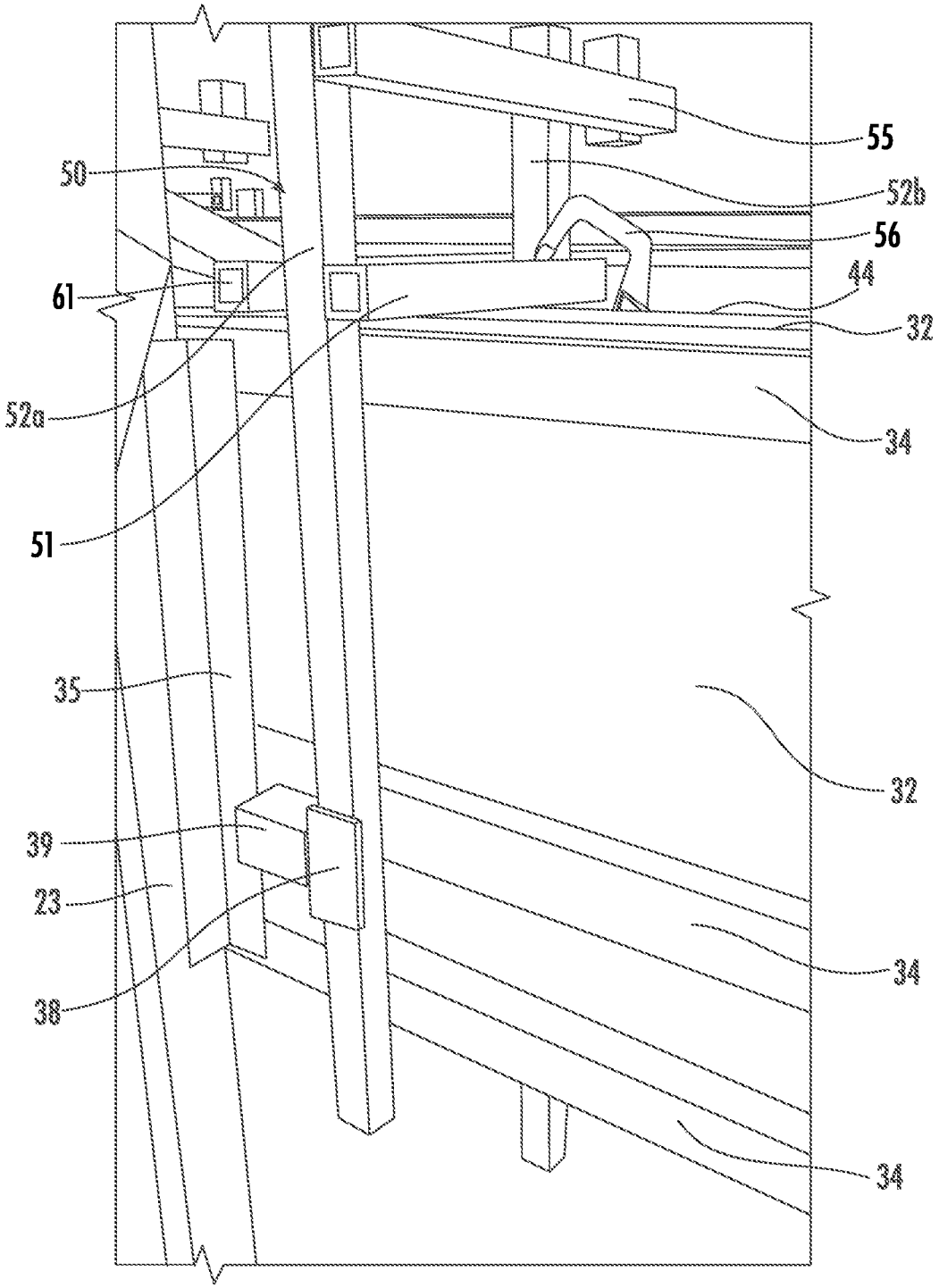
FIG. 8 is a perspective view of an outer form panel and support member according to an embodiment.
Figure 9:
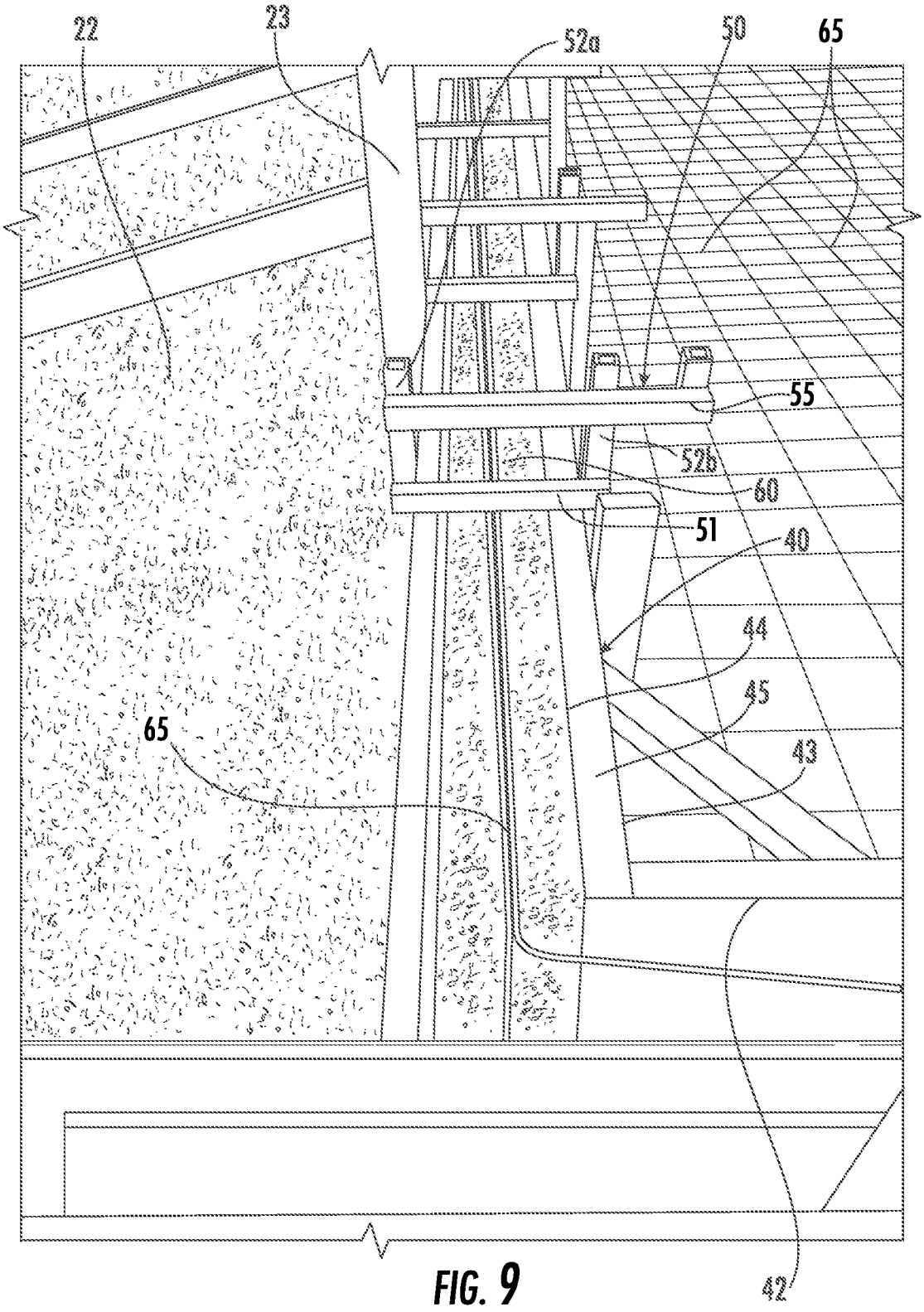
FIG. 9 is a top perspective view of a portion of a form system according to an embodiment.

Referring additionally to FIGS. 3-4, each outer form panel 30 also has opposing inner and outer sides 36, 37, the outer side corresponding to the side of the outer form panel with the spaced apart ribs 34. Each outer form panel 30 also includes a support member bracket 38 extending from the outer side 37 of each outer form panel. Each support member bracket 38 is illustratively has an L-shape so a first leg of the L-shape extends outwardly from one of the spaced apart ribs 34 (e.g., spaced from the top of each outer form panel 30, such as, the second from the top), and the other leg (traverse to the first leg) extends in a direction parallel to the plane of the smooth rigid panel 32. A respective support body 39 may be coupled to each support member bracket 38 and the corresponding spaced apart rib 34 for further support, particularly, when used with a support member 50, as will be described in further detail below.

Each outer form panel 30 may have a different size and shape so as to be coupled together to form a desired shape of an outer form wall 31 of an in-ground swimming pool. In other words, outer form panels 30 may be selected from a kit of many different sized and shaped inner form 40 panels to create a desired in-ground swimming pool shape. Moreover, while flat or planer outer form panels 30 are illustrated, those skilled in the art will appreciate that an outer form panel 30 may be curved or rounded.

Referring additionally to FIGS. 5-9, at Block 112, inner form panels 40 are positioned in side-by-side relation and in spaced relation (i.e., spaced apart) from the inner side 36 of the outer form walls 31 to define an inner form wall 41. The inner and outer form walls 31, 41 together define a wall space 60 therebetween. Similar to the outer form walls 31, each inner form wall 41 also has opposing inner and outer sides 42, 43.

Each inner form panel 40 includes a smooth rigid panel 44 defining the inner side 42 of the inner form panel and spaced apart ribs 45 laterally coupled along a length of the smooth rigid panel defining the outer side 43 of the inner form panel. The smooth rigid panel 44 and spaced apart ribs 45 may be steel, for example, galvanized steel. The smooth rigid panel 44 and spaced apart ribs 45 may each be another or different materials. Each of the spaced apart ribs 45 is illustratively in the form of a square tube, for example, having a 2"×2" size.

Each of the spaced apart ribs 45 may be a different size, and the amount of spaced apart ribs may be based upon the size and shape of each inner form panel 40. For example, longer or deeper (e.g., for deeper excavated areas of the ground 22) inner form panels 40 may have four spaced apart ribs 45, while inner form panels for more shallow excavated areas, such as, for example, spas or sun-shelves, may have less than four spaced apart ribs.

In some embodiments, each inner form panel 40 may include angled brackets 46 coupled to the inside of the smooth rigid panel 44 between adjacent ribs 45. The angled brackets 46, similar to the angled brackets 35 on the outer wall panels 30, may have an L-shape. The positioning of the inner form panels 40 in side-by-side relation to define the inner form wall 41 may include coupling, for example, using fasteners 47, adjacent inner form panels using by way of the angled brackets 46. As will be appreciated by those skilled in the art the angled brackets 46 are positioned from the ends of each inner form panel 40 so that adjacent panels are coupled together in side-by-side relation without spacing therebetween.

Each inner form panel 40 may have a different size and shape so as to be coupled together to form a desired shape of an inner wall 41 of an in-ground swimming pool and to match the shape of the outer wall 31. In other words, inner form panels 40 may be selected from a kit of many different sized and shaped inner form panels to create a desired in-ground swimming pool shape. Moreover, while flat or planer inner form panels 40 are illustrated, those skilled in the art will appreciate that an inner form panel may be curved or rounded.

The method further includes, at Block 114, coupling support members 50 between the outer side 43 of respective inner form panels 40 and respective support member brackets 38. More particularly, each support member 50, which includes a base member 51 and a pair of arms 52*a*, 52*b* extending outwardly from the base to define an inverted U-shape or hump-shape, is positioned over the wall space 60. Each support member 50 may include or be formed of metal, for example, steel, and more particularly have a square tubular base member 51 and arms 52*a*, 52*b*. The square shape of the arms 52*a*, 52*b* matches the shape of the support member bracket 38 so that the arm can be received, for example, slidably, therein, or engaged with the support member bracket 38. Accordingly, one of the arms 52*b* is secured to an uppermost rib 45 of the respective inner form panel 40, for example, using a clamp 56 (e.g., a c-clamp) (FIG. 8), while the other arm 52*a* is slidably positioned within the support member bracket 38. Of course, the support members 50 including the base 51 and arms 52*a*, 52*b* may have another shape, such as a round shape, and thus, the support member bracket 38 may also have a different shape, for example, to match one of the arms 52*a*, 52*b*. Other types of securing mechanisms may be used to secure the support member 50 to the inner form panel 40.

Each support member 50 may include a further base member 55 spaced from the base member 51. In use, each support member 50 may be positioned over the corresponding outer and inner form panels 30, 40 and lowered so that the arm 52*a* engages the support member bracket 38 (which may also be referred to as an angle-iron) from the topside. The support member 50 may also be rotated or tilted so that the arm 52*a* engages the support member bracket 38 from the side (i.e., the open side of support member bracket). The support member bracket 38 secures the support member 50 so that the outer and inner form panels 30, 40 remain level and so that the support member can be secured more easily to the inner form panel. Thus, the support member 50 may be considered a type of anchor for the outer and inner form panels 30, 40. Without the support member bracket 38, the support member 50 may not sit level. For example, the arm 52*a* may be spaced from the outer form panel 30, and more particularly from the one of the ribs 45, so that the form panels will not remain level. Removal of the support member 50, for example, when desirable to remove the form panels, may include removing the clamp 56 and sliding the support member 50 upwardly or outwardly from the support member bracket 38.

As will be appreciated by those skilled in the art, the use and configuration of the support members 50 advantageously secures the inner form panels 40 and also levels the inner form wall 41 relative to the outer form wall 31. In some embodiments, support posts 23 may be inserted into the excavated ground 22 and coupled to the inner form panels 40 similar to the coupling arrangement between the support posts 23 and the outer form panels 30.

Figure 10:
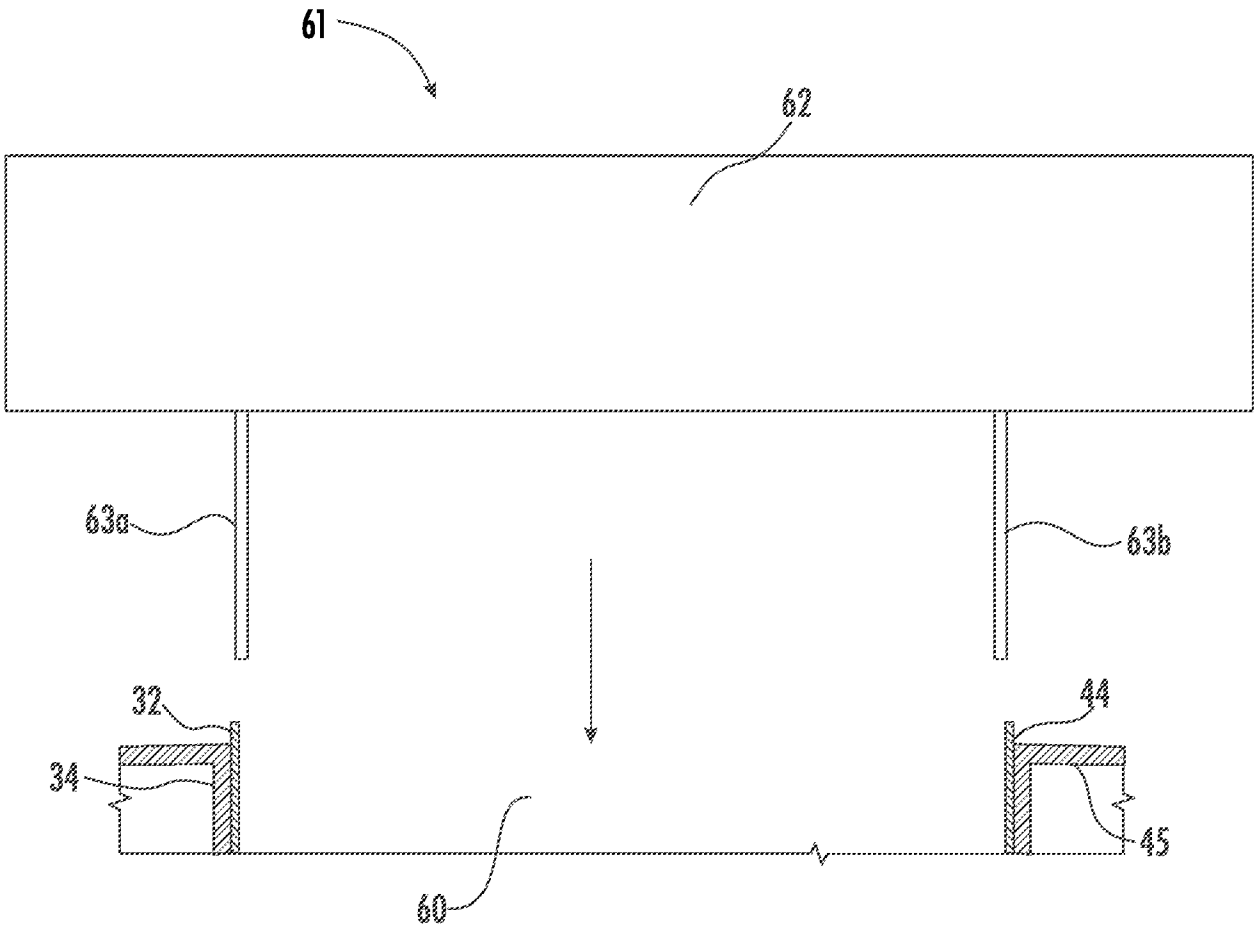
FIG. 10 is a schematic diagram of a spacer of a form system according to an embodiment.

Referring additionally to FIG. 10, spacers 61 may optionally be positioned in the wall space 60 (Block 116). The spacers 61, which may also be made of metal, and more particularly, the same material as the form panels 30, 40, each includes a base 62 and spaced apart legs 63*a*, 63*b*. The legs 63*a*, 63*b* are spaced apart to slidably fit between and in contact with the inner sides 36, 42 of the inner and outer form walls 31, 41. The spacers 61 advantageously help maintain the wall space 60. The size of the spacers 61, and more particularly, the spacing between the spaced apart legs 63*a*, 63*b* may be different and match a desired wall thickness.

Figure 11:
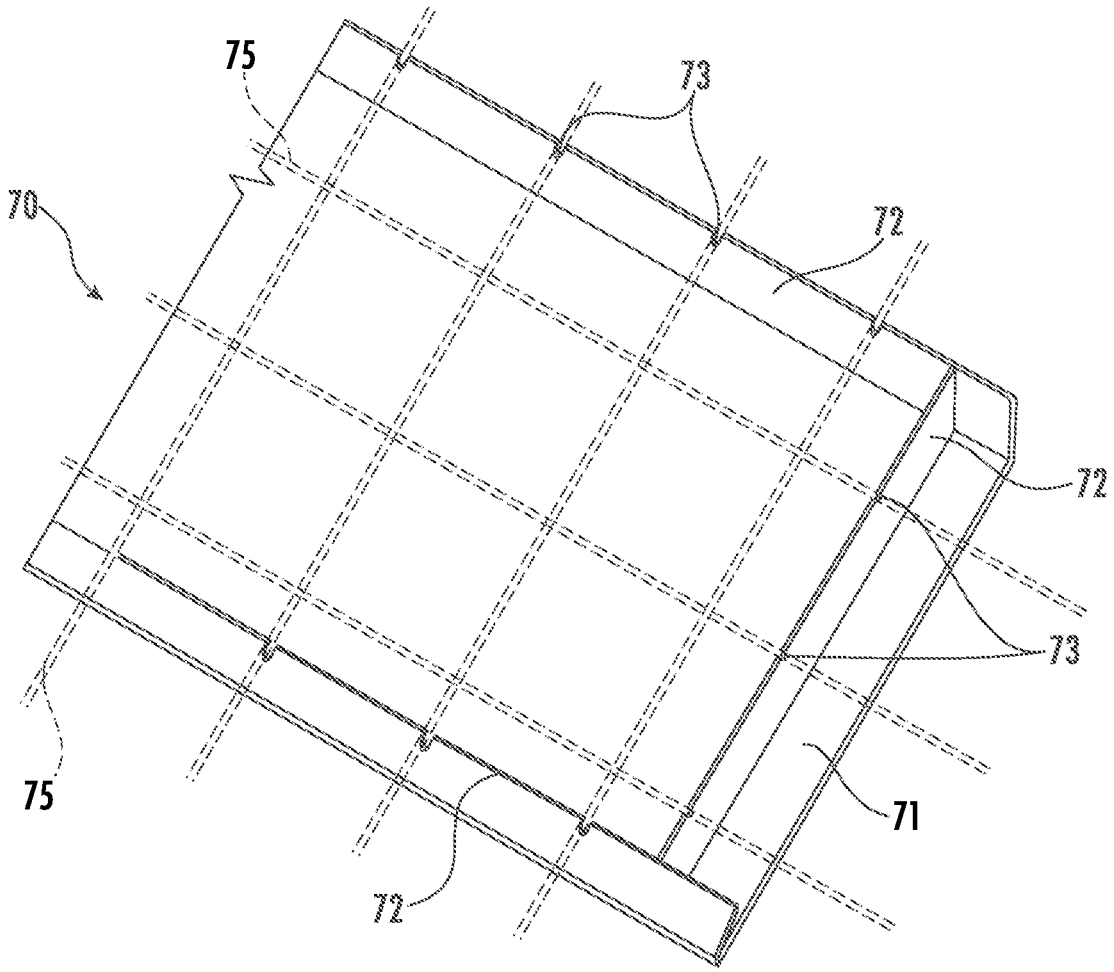
FIG. 11 is a schematic diagram of a rebar forming panel of a form system according to an embodiment.

Rebar 65 configured as a mesh may be positioned in the wall space 60 and along the excavated area bottom to define what will be the floor of the in-ground swimming pool (Block 118). Referring briefly to FIG. 11, a rebar forming panel 70 may be used to facilitate the building and setup of the mesh rebar structure. The rebar forming panel 70 includes a base panel 71 and risers 72 adjacent or along a perimeter of the base panel having recesses 73 therein spaced, for example, uniformly, about the risers.

The shape or layout of and sizing of the risers 72 corresponds to either or both of an inner and outer form panel 30, 40. The recesses 73 are sized to receive individual rebar rods 75 therein. The rebar forming panel 70, as will be appreciated by those skilled in the art, permits the rebar 65 to be pre-fabricated (i.e., not in the field or at the construction site as is conventionally done) into mesh panels. The spacing of the individual rebar rods 75 is thus done in accordance with desired building specifications and/or codes, which in turn, corresponds to quicker installation and may also reduce an amount of inspection rejections.

Figure 12:
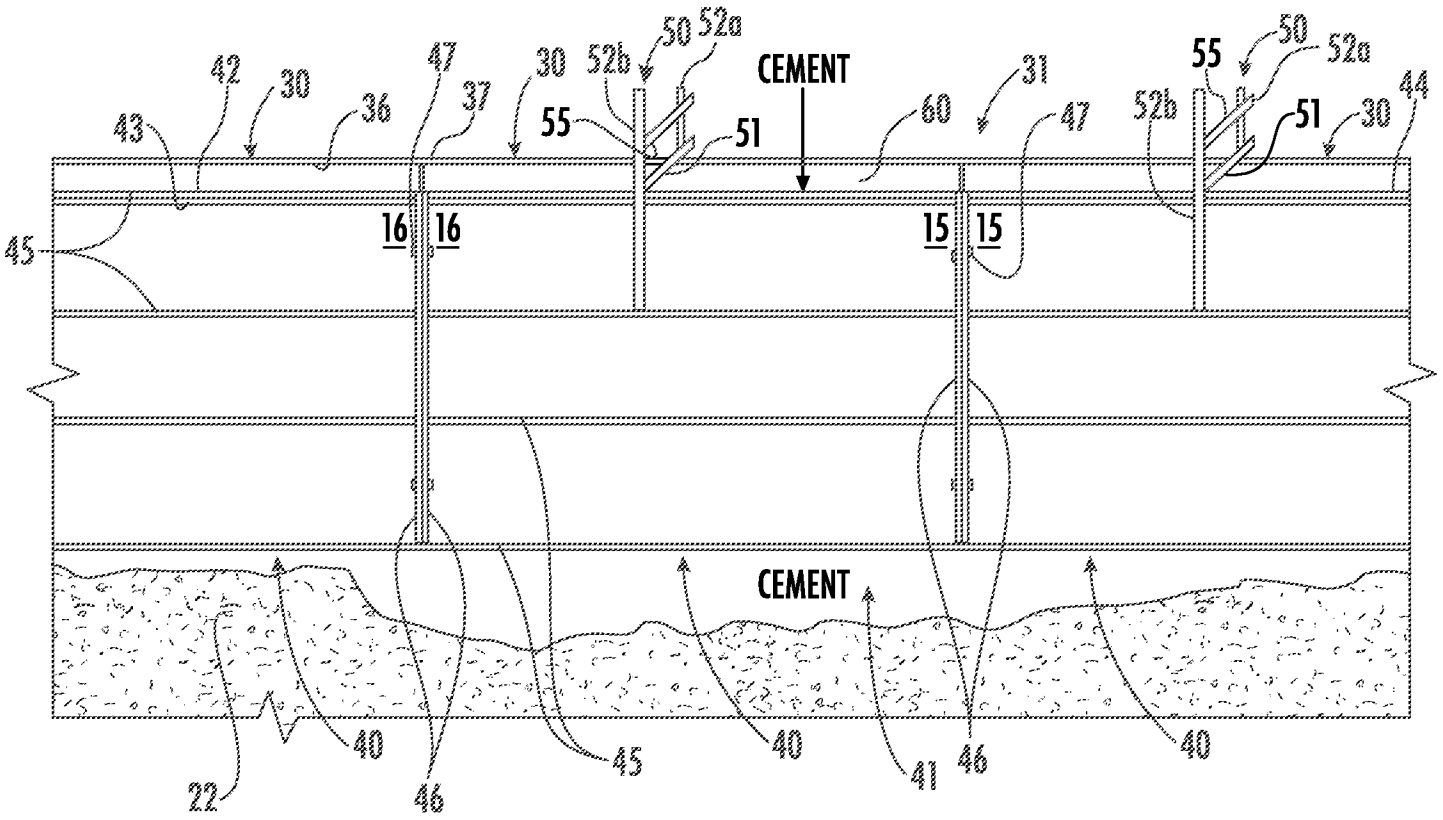
FIG. 12 is a schematic diagram illustrating cement flow in a wall space using a form system according to an embodiment.

Referring additionally to FIG. 12, at Block 120, cement, for example, concrete, is injected within the wall space 60 to partially fill the wall space. The cement, which may be sourced from a ready-mix truck, may not be sprayed, such as, for example, gunite, shotcrete, or sprayed concrete. The cement, which may be poured in the wall space 60, may be 2000-6000 psi concrete, and more particularly 4000 psi concrete. The cement is injected to partially fill the wall space 60. More particularly, the cement is injected from the top of the wall space 60 or adjacent the top of the inner and outer form walls 31, 41. As the cement is injected, it falls within the wall space 60 and, because of the spacing of the inner and outer form walls 31, 41 from the ground 22 in the excavated area, the cement will flow from the bottom of the wall space to what will be the floor of the in-ground swimming pool. Those skilled in the art will appreciate that the cement may be vibrated, for example, by hitting the inner form wall 41 with a mallet or hammer to facilitate its flow. As the cement flows, it can be troweled and curved to define a floor-to-wall transition. As the floor-to-wall transition is being formed or troweled, the cement is curing. Cement is permitted to partially, and not fully, fill the wall space 60.

Figure 13B:
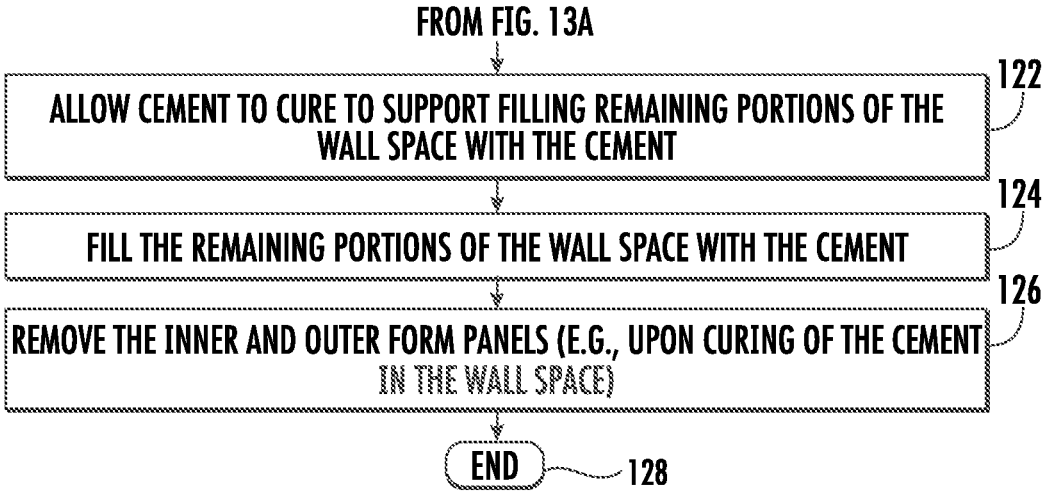
FIG. 13*b* is another flow diagram of the method of constructing the in-ground swimming pool from FIG. 13*a*.
Figure 14:
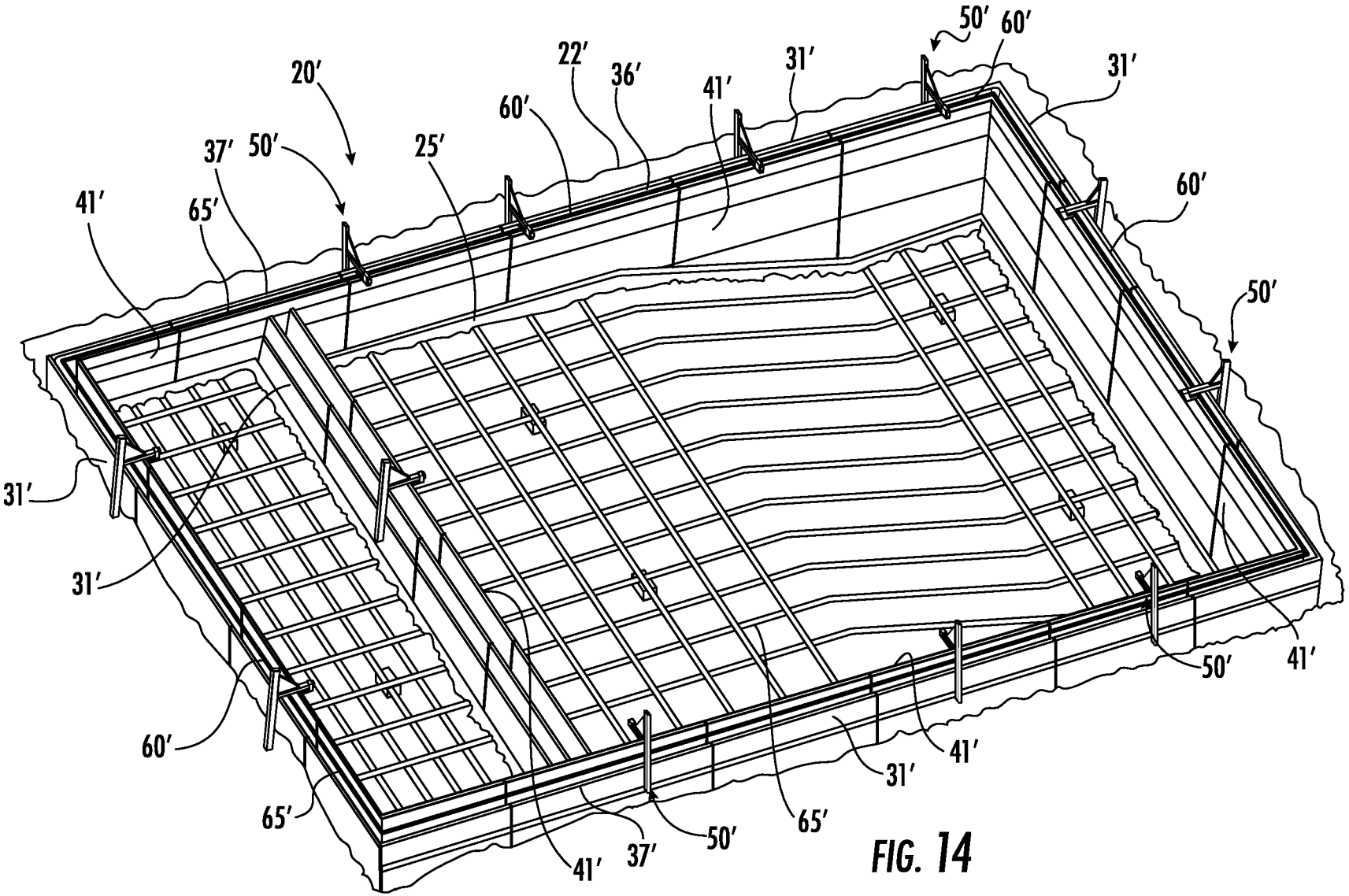
FIG. 14 is a schematic diagram of an in-ground swimming pool including a form system according to another embodiment.
Figure 15:
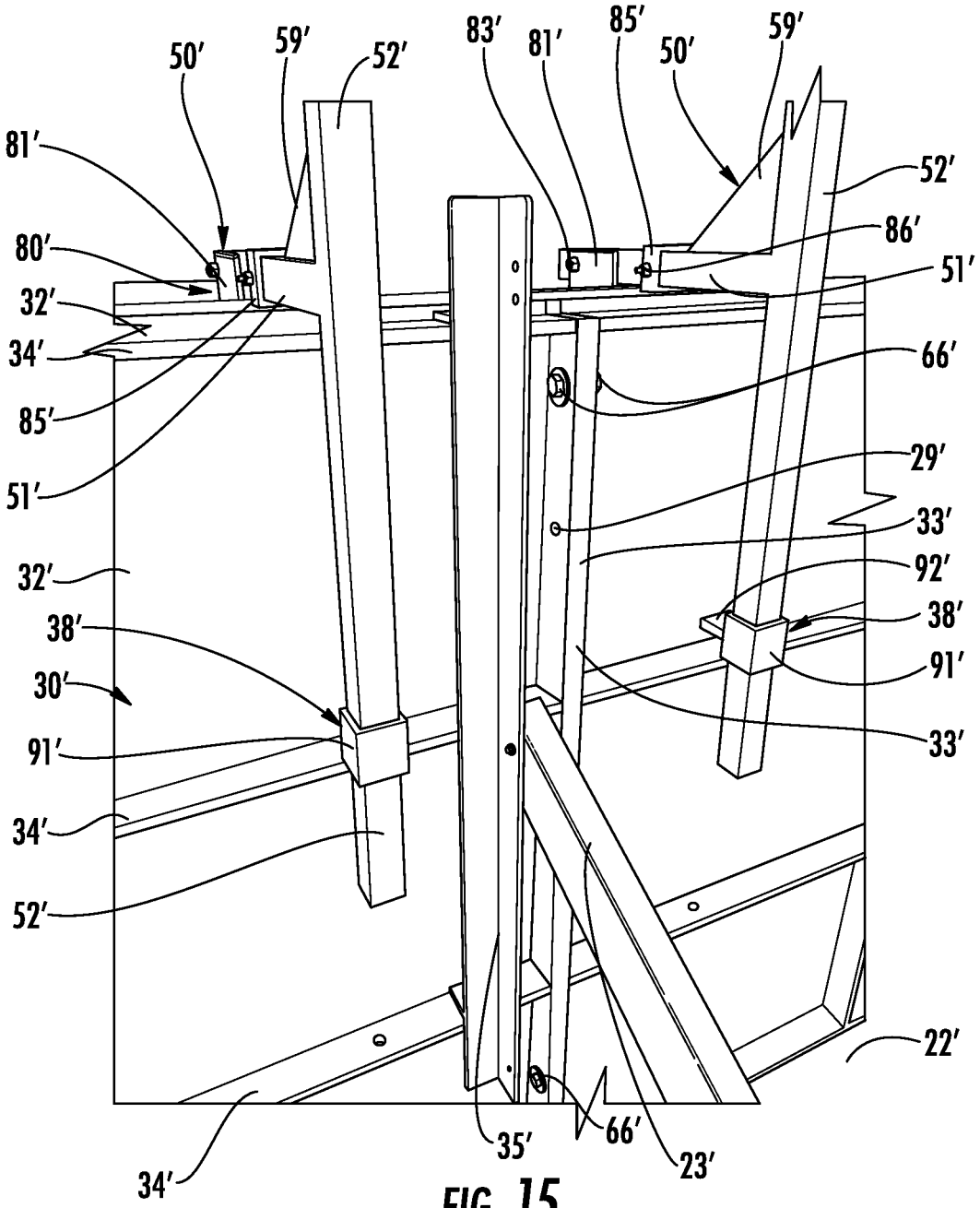
FIG. 15 is a schematic diagram of a portion of a form system in accordance with an embodiment.
Figure 16:
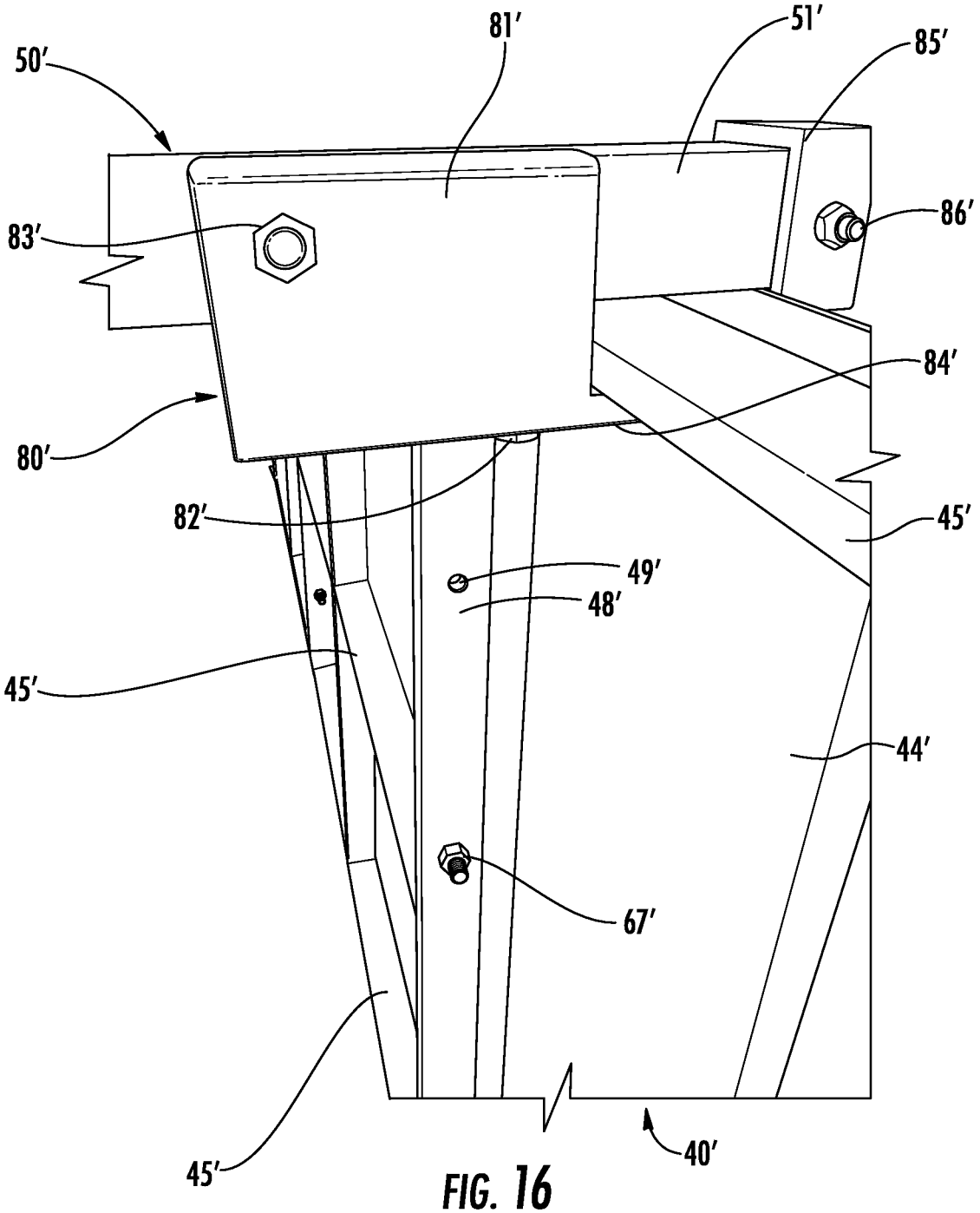
FIG. 16 is another schematic diagram of a portion of a form system in accordance with an embodiment.
Figure 17:
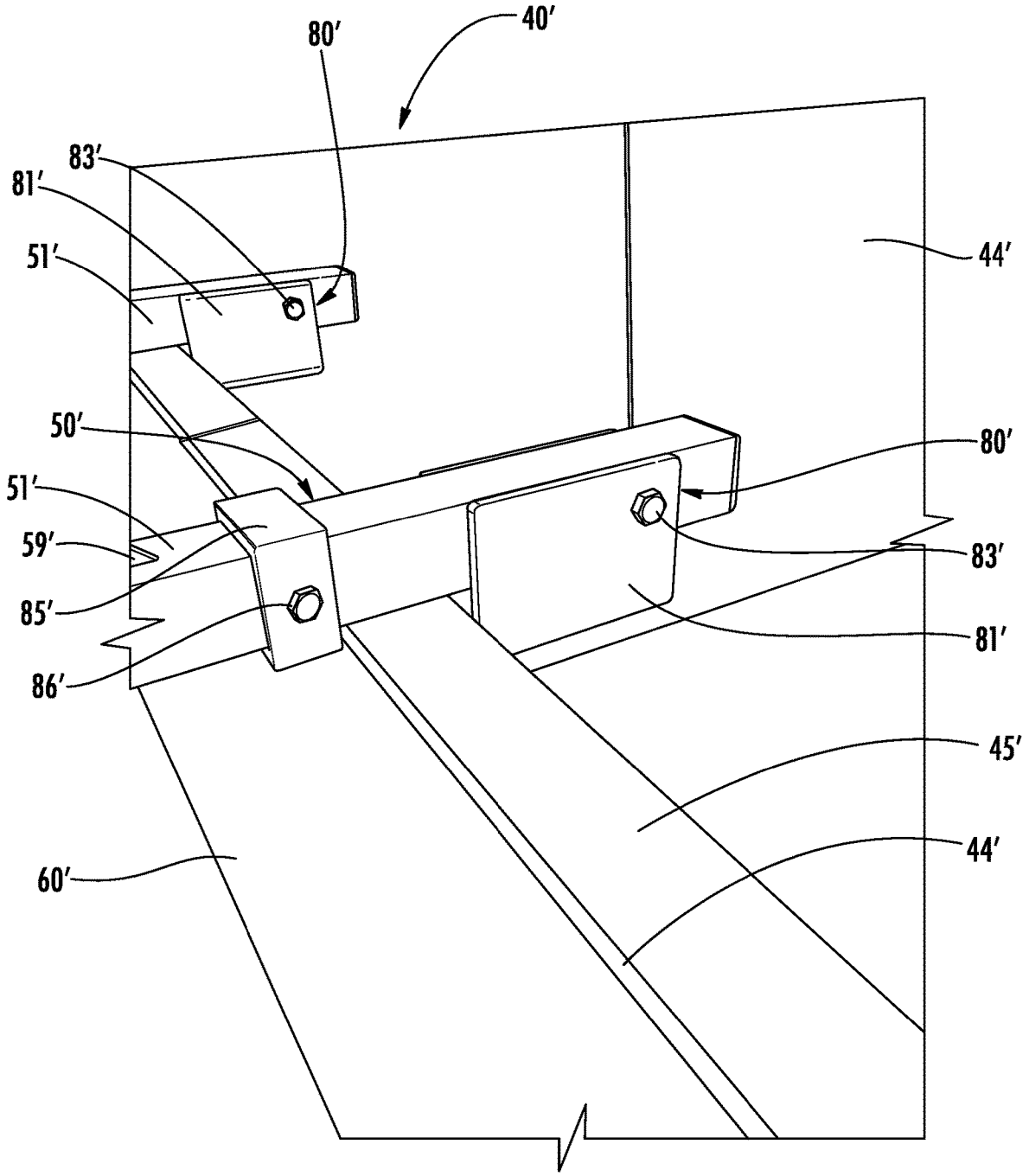
FIG. 17 is another schematic diagram of a portion of a form system in accordance with an embodiment.
Figure 18:
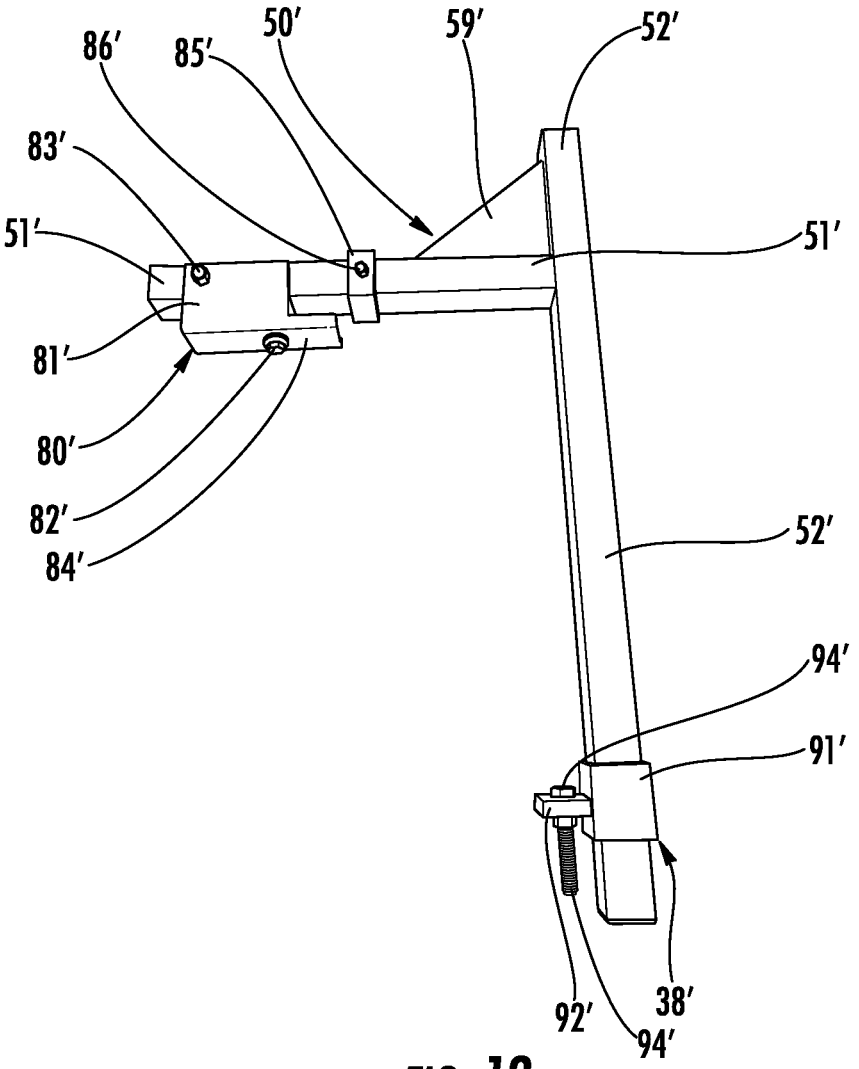
FIG. 18 is a schematic diagram of a support member and support member bracket in accordance with an embodiment.

Referring additionally to the continuation of flowchart 100 in FIG. 13B, after a sufficient curing time for the partially filled wall space 60, for example, 30-minutes (Block 122), remaining portions of the wall space 60 are filled with cement (Block 124). While 30-minutes is an exemplary curing time, it should be appreciated by those skilled in the art that the curing time may be different, for example, a sufficient curing time so as to support the weight of the cement after filling the remaining portions of the wall space 60.

At Block 126, upon curing of the remaining portions of the cement, the inner and outer form panels 30, 40 are removed exposing cement walls of the in-ground swimming pool 20, the inner side facing pool water and the outer side facing the ground. The space between the outer side of the cement pool wall and the excavated ground may be back-filled to remove that space. The method ends at Block 128.

As will be appreciated by those skilled in the art, the inner and outer form panels 30, 40 may be different sizes and shapes so that they can be configured to a desired pool shape or design. In some embodiments, the inner and/or outer form panels 30, 40 may be have numbers, letters, or other indicia thereon. The indicia may provide a reference to an installer so as to setup the inner and outer form panels 30, 40 for a particular configuration. For example, a given configurations from among a plurality thereof may be selected and correspond to a panel arrangement, for example, provided by reference guide. The inner and outer form panels 30, 40 may be configured according to the guide and corresponding to the selected configuration. This may further reduce installation time.

Accordingly, the method, and system, described herein may advantageously reduce a construction duration for an in-ground swimming pool. For example, a typical in-ground swimming pool 20 may take about three to four months to complete. The method described herein using the inner and outer form panels 30, 40 may reduce in-ground swimming pool construction to about a week. In particular, the method of constructing an in-ground swimming pool 20 using the form system described herein advantageously permits the floor and walls to be poured or constructed at what may be considered the same time (i.e., with the outer and inner form panels 30, 40 in place and, for example, on a single given day). This is in contrast to other conventional form systems that require the floor and walls to be poured or constructed over a 4-5 day period, which typically involves pouring the walls then removing the forms and then subsequently pouring the floor.

A system aspect is directed to a form system for an in-ground swimming pool 20. The form system includes outer form panels 30 in side-by-side relation defining an outer form wall 31 within an area of ground 22 corresponding to a desired in-ground swimming pool shape. Each outer form panel 30 has opposing inner and outer sides 36, 37 and a support member bracket 38 extending from the outer side. The form system also includes inner form panels 40 in side-by-side relation and in spaced relation from the inner side 42 of the inner form panels 40 to define an inner form wall 41. The inner and outer form walls 31, 41 define a wall space 60 therebetween, and each inner form panel 40 has inner and outer sides 42, 43. The form system also includes support members 50 over the wall space 60 and coupled to an outer side 43 of the inner form panels 40 and to respective ones of the support member brackets 38.

Referring now to FIGS. 14-18, in another embodiment, the form system for an in-ground swimming pool 20' includes outer form panels 30' to be coupled in side-by-side relation defining an outer form wall 31' within an area of excavated ground 22' corresponding to a desired in-ground swimming pool shape. Similar to the embodiments described above, each outer form panel 30' includes a wall panel 32' or smooth rigid panel defining the inside 36' of the outer form panel, and spaced apart longitudinal ribs 34' (e.g., horizontal) or supports coupled along a length of the wall panel defining the outer side 37' of the outer form panel. The uppermost longitudinal rib 34' is illustratively recessed from the upper edge of the wall panel 32'. In other words, the uppermost longitudinal rib 34' and the upper edge of the wall panel 32' are not aligned or coextensive. Of course, in some embodiments, the uppermost longitudinal rib 34' and the upper edge of the wall panel 32' are not aligned or coextensive. The wall panel 32' and spaced apart longitudinal ribs 34' may be steel, for example, galvanized steel. The wall panel 32' and spaced apart longitudinal ribs 34' may each be another or different materials. The amount and shape of the spaced apart longitudinal ribs 34' may be based upon the size and shape of each outer form panel 30'. For example, longer or deeper (e.g., for deeper excavated areas of the ground 22') outer form panels 30' may have four spaced apart ribs 34', while outer form panels for more shallow excavated areas, such as, for example, spas or sun-shelves, may have less than four spaced apart ribs.

Each outer form panel 30' also includes lateral supports 33' (e.g., vertical) or ribs at opposing ends of the wall panel 32'. Each lateral support 33' has openings 29' therein, each for receiving a fastener 66' (e.g., a threaded fastener) therethrough to secure adjacent outer form panels 30' in the side-by-side relation. Other types of fasteners may be used, for example, clamps.

The outer form panels 30' are illustratively coupled to support posts 23', as described above, so that the outer form panels are supported upright within the excavated area of ground 22'. The support posts 23' may be wood, for example, 2×4. The support posts 23' may be another type or size of material. The outer form panels 30' may rest on the excavated area of ground 22'. Angled brackets 35' are coupled to the spaced apart longitudinal ribs 34' and have an L-shape Each outer form panel 30' also includes a support member bracket 38' extending from the outer side 37' of each outer form panel. Each support member bracket 38' is illustratively carried by a medial longitudinal support rib 34' that extends along a middle of the wall panel 32'. Each support member bracket 38' includes a bracket body 91' defined by an opening 93' and a mounting flange 92' extending outwardly from the bracket body (i.e., not extending within the opening). The mounting flange 92' has an opening therein to receive a fastener 94' therethrough for coupling to the longitudinal support rib 34'. The bracket body 91' and the mounting flange 92' are sized so that the mounting flange is positioned flush against the wall panel 32' while an edge of the bracket body rests on the longitudinal rib 34'. The amount of the bracket body 91' that rests on the longitudinal rib 34' may correspond to a thickness of the bracket body (i.e., the amount of material from the opening to the outer edge).

Each outer form panel 30' may have a different size and shape so as to be coupled together to form a desired shape of an outer form wall 31' of an in-ground swimming pool. In other words, outer form panels 30' may be selected from a kit of many different sized outer and inner form panels to create a desired in-ground swimming pool shape. Moreover, while flat or planer outer form panels 30' are illustrated, those skilled in the art will appreciate that an outer form panel may be curved or rounded.

The form system for the in-ground swimming pool 20' includes inner form panels 40' to be coupled in side-by-side relation defining an inner form wall 41'. The inner form panels 40' are to be positioned in side-by-side relation and in spaced relation (i.e., spaced apart) from the inner side 36' of the outer form walls 31' to define an inner form wall 41'. The inner and outer form walls 31', 41' together, when positioned, define a wall space 60' therebetween. Similar to the outer form walls 31', each inner form wall 41' also has opposing inner and outer sides 42', 43'.

Similar to the embodiments described above, each inner form panel 40' includes a wall panel 44' or smooth rigid panel defining the inside 42' of the inner form panel, and spaced apart longitudinal ribs 45' (e.g., horizontal) or supports coupled along a length of the wall panel defining the outer side 43' of the inner form panel. The uppermost longitudinal rib 45' is illustratively recessed from the upped edge of the wall panel 44'. In other words, the uppermost longitudinal rib 45' and the upper edge of the wall panel 44' are not aligned or coextensive. Of course, in some embodiments, the uppermost longitudinal rib 45' and the upper edge of the wall panel 44' are not aligned or coextensive. The wall panel 44' and spaced apart ribs 45' may be steel, for example, galvanized steel. The wall panel 44' and spaced apart ribs 45' may each be another or different materials. The amount and shape of the spaced apart ribs 45' may be based upon the size and shape of each inner form panel 40'. For example, longer or deeper (e.g., for deeper excavated areas of the ground 22') inner form panels 40' may have four spaced apart ribs 34', while inner form panels for more shallow excavated areas, such as, for example, spas or sun-shelves, may have less than four spaced apart ribs.

The inner form panels 40' are shorter in height than the outer form panels 30'. In other words, while the outer form panels 30' rest on the excavated area of ground, the inner form panels 40' are sized so that when aligned, e.g., lengthwise, along the top of the outer form panels, the inner form panels are spaced from the excavated area of ground.

Each inner form panel 40' also includes lateral supports 48' (e.g., vertical) or ribs at opposing ends of the wall panel 44'. Similar to the outer form panels 30', each lateral support 48' has openings therein 49', each for receiving a fastener 67' (e.g., a threaded fastener) therethrough to secure, along, adjacent inner form panels 40' in the side-by-side relation. Other types of fasteners may be used, for example, clamps.

Each inner form panel 40' may have a different size and shape so as to be coupled together to form a desired shape of an inner form wall 41' of an in-ground swimming pool and to match the shape of the outer form wall 31'. In other words, inner form panels 40' may be selected from a kit of many different sized and shaped inner form panels to create a desired in-ground swimming pool shape. Moreover, while flat or planer inner form panels 40' are illustrated, those skilled in the art will appreciate that an inner form panel may be curved or rounded.

The form system also includes support members 50' to couple the outer form panels 30' in spaced relation from the inner form panels 40' and to define the wall space 60' therebetween. More particularly, the support members 50' may be coupled between the outer side 43' of respective inner form panels 40' and respective support member brackets 38'.

Each support member 50' includes a base member 51' that is to be carried by respective ones of the outer and inner form panels 30', 40'. In other words, the base members 51', when coupled, rests on a top end of the inner and outer form panels 30', 40', and more particularly, the wall panels 32', 44', and across or over the wall space 60'. The base members 51' may be in the form of a tubular base member (e.g., rectangular or rounded).

Each support member 50' also includes an arm 52' that extends from the base member 51' for coupling to the respective outer form panel 30'. More particularly, the arm 52' is traverse to the base member 51' and extends upwardly from the and downwardly below the base member (e.g., defining a T-shape with the base member) from an end of the base member. The arm 52' may not extend beyond the base member 51' in some embodiments (e.g., defining an L-shape). The arm 52', when the support member 50' is positioned or coupled to the inner and outer form panels 30', 40', extends downwardly from the top of the outer form panel to within the passageway of the respective support member bracket 38'. The arm 52', similar to the base member 51', may be tubular and shaped to match the shape of the passageway of the support member bracket 38'. As will be appreciated by those skilled in the art, the support member 50' may advantageously facilitate positioning and proper alignment of the inner and outer wall panels 40', 30'.

Each support member 50' also includes a reinforcement brace 59' that has a triangular shape and is coupled between the base member 51' and the portions of the arm 52' that extend above or upwardly beyond the base member. In some embodiments, there may be no reinforcement brace 59' or the reinforcement brace may have a different shape and/or size.

Each support member 50' also includes a wall support member 80' for coupling to the respective inner form panel 40'. Each wall support member 80' includes a wall support body 81' that is carried by the base member 51'. The wall support body 81' has a U-shape, for example, an elongate U-shape. The U-shape (i.e., spacing between the arms thereof) is sized to receive the base member 51' therein. The wall support body 81' has an opening therein in each of the arms to receive a fastener 83' therein, for example, a threaded fastener, screw/nut, etc. The fastener 83' also extends through the base member 51' to secure the wall support wall support body 81' to the base member. The wall support member 80' may be movable or adjustable along the base member 51', for example, by way of a slotted opening in the base member, to accommodate different sized wall spaces 60' or wall thicknesses, as will be appreciated by those skilled in the art.

The fastener 83' permits the wall support body 81' to pivot about the fastener to facilitate assembly and coupling. For example, the wall support body 81' may be rotated (e.g. prior to tightening of the fastener 83') upwardly to engage the bottom of the adjacent longitudinal support rib 45'. The wall support body 81' may be further secured from pivoting by way of another fastener 82' through the base portion of the U-shaped wall support body, and may engage the base member 51'. In some embodiments, the fastener 83' may not be used or another type of or fastening arrangement may be used.

Each wall support member 80' also includes a wall support lip 84' that extends from the wall support wall support body 81'. In other words the base of the U-shape has a length longer than the arms of the U-shape to define the wall support lip 84'. The wall support lip 84' is for engaging the respective inner form panel 40' so that the respective inner form panel is suspended from the wall support lip. In other words, during operation, the uppermost longitudinal support rib 45' of each of the inner form panels 40' are hung on the wall support lip 84'.

A form stop 85' that is illustratively in the form of a sleeve is carried by the base member 51'. The form stop 85' being in the form of sleeve around the base member 51' is slidable along the base member in the wall space 60' (i.e., on an opposing side of the inner wall panel 44'. The form stop 85' is secured to the base member 51', thus stopping it from sliding, by way of a respective fastener 86'. During assembly of the form system, the form stop 85' may be slid adjacent or in contact with the inner wall panel 44' within the wall space 60' to secure the wall support member 80' so that the inner form panel 40' does not fall from the wall support lip 84'.

Figure 19:
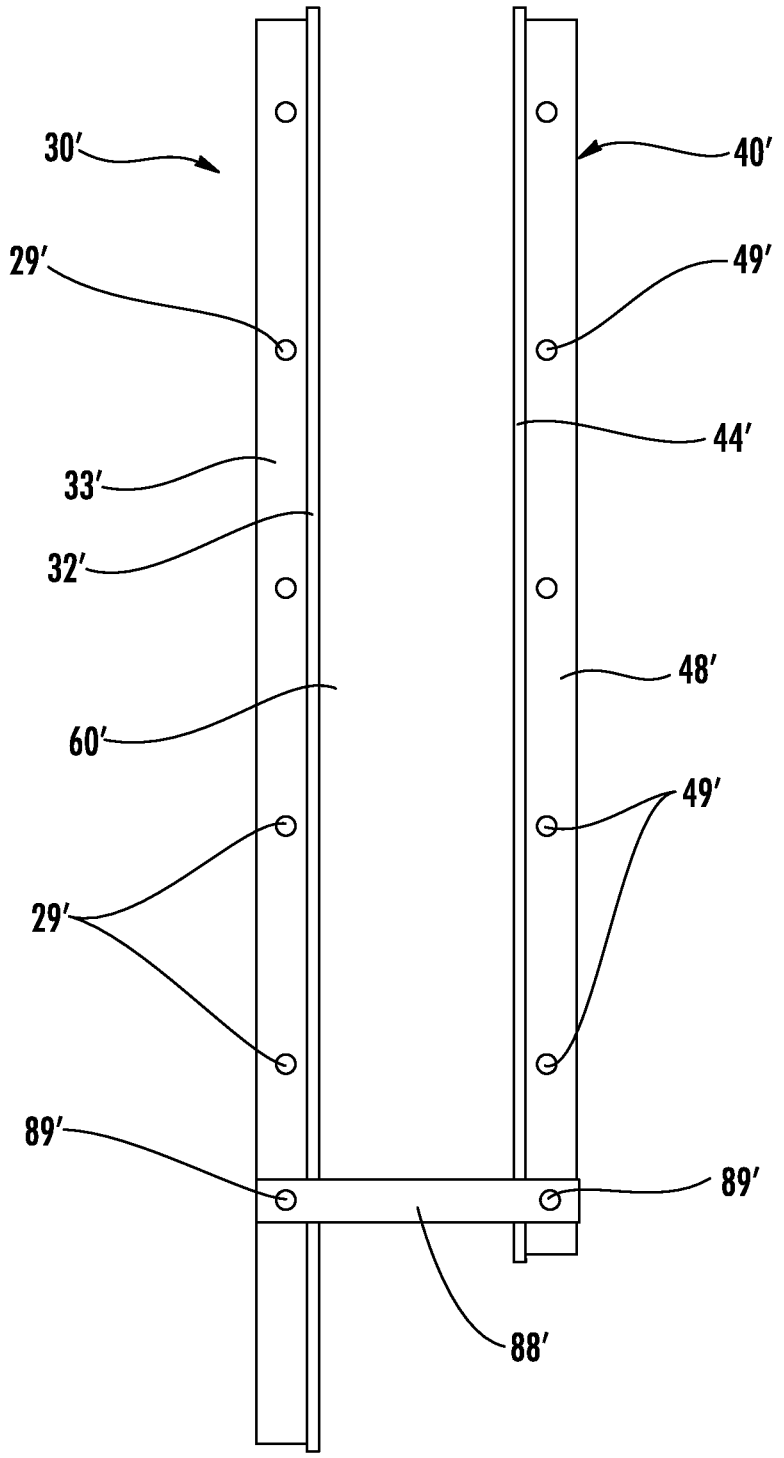
FIG. 19 is schematic diagram of a portion of inner and outer form panels in accordance with an embodiment.

Referring additionally to FIG. 19, the form system may include snap ties 88' that may be relatively thin or flat, but rigid, rectangular bodies (e.g., metallic) and have openings 89' therein at opposing ends. Each snap tie 88' may be coupled to ends or edges of the inner and outer form panels 40', 30' along a bottom thereof or near the ground by fasteners. More particularly, each snap tie 88' may couple to the lateral supports 33', 48' by way of respective fasteners through aligned openings 89' in the snap ties and the openings 29', 49' in the lateral supports 33', 48'.

Each snap tie 88', when coupled to the inner and outer form panels 40', 30' extends across the wall space 60'. Each snap tie 88' advantageously maintains the spacing between the inner and outer form panels 30', 40' or the size of the wall space 60'. Those skilled in the art will appreciate that there may be tendency of the bottoms of inner form panels 40', when engaged with the wall support lip 84' or hung, to swing either inwardly into the wall space 60' or outwardly away from the wall space. If this occurs, the wall, after being formed, may not be straight or flat. The snap ties 88' may reduce or prevent the inner form panels 40' from moving adjacent the bottom thereof, for example, pivoting at or from the wall support lip 84', thus maintaining the size of the wall space 60' or the spacing between the inner and outer wall panels 30', 40'. While generally flat rectangular and metallic snap ties 88' are illustrated, it will be appreciated by those skilled in the art that other types of ties (e.g., other shapes, materials, coupling arrangements) may be used. Elements illustrated but not specifically described herein are similar to those described with respect to the above-embodiments and need not be further described.

Figure 20:
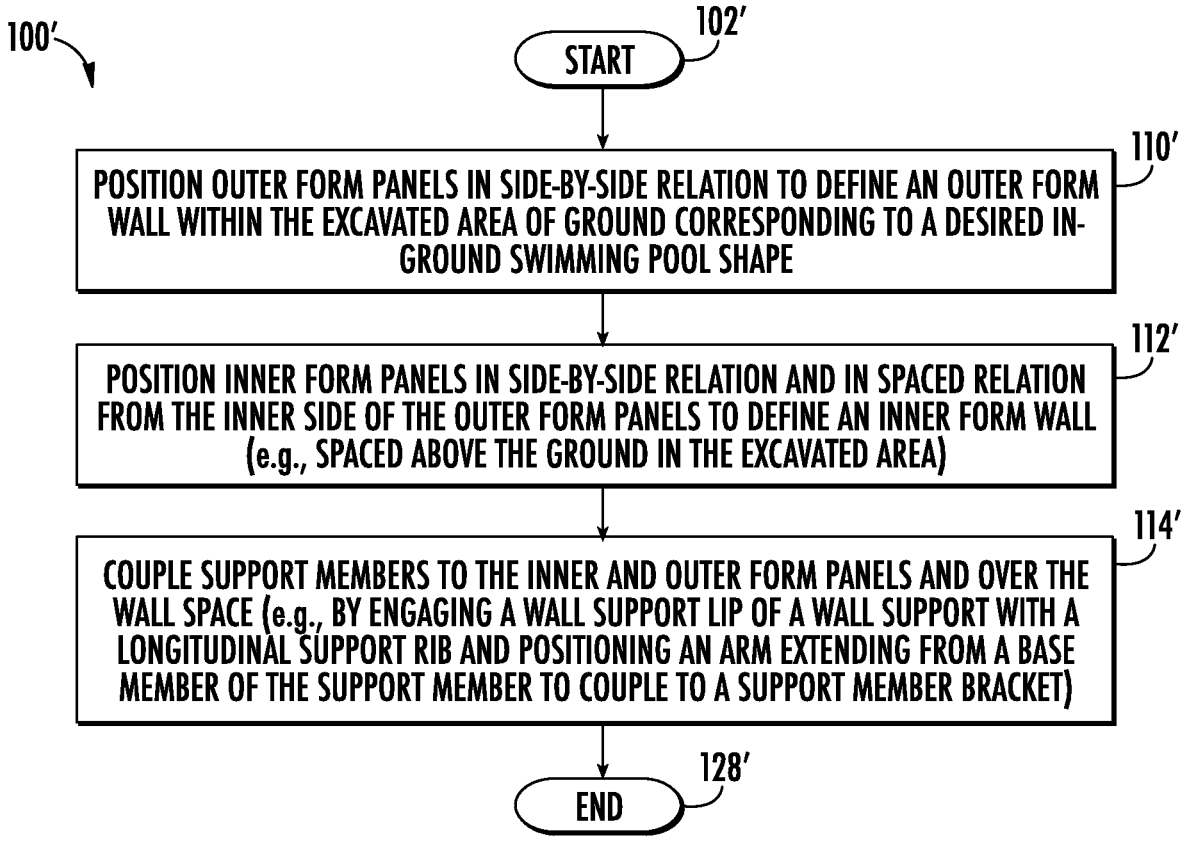
FIG. 20 is flow diagram of a method of constructing an in-ground swimming pool.

Referring now to the flowchart 100' in FIG. 20, beginning at Block 102', a method of constructing an in-ground swimming pool 20' is described. At Block 110', the method includes positioning outer form panels 30' in side-by-side relation to define the outer form wall 31'. At Block 112', inner form panels 40' are positioned in side-by-side relation and in spaced relation (i.e., spaced apart) from the inner side 36' of the outer form walls 31' to define the inner form wall 41'.

The method further includes, at Block 114', coupling support members 50' to the inner and outer form panels 40', 30' and over the wall space 60', for example, to maintain the wall space or the inner and outer wall panels in spaced relation. More particularly, the support members 50' are coupled by engaging a wall support lip 84' of a wall support member 80' with the longitudinal support rib 45', for example, an uppermost longitudinal support rib, of the inner form panel 40'. More particularly, coupling each support member 50' may include coupling or positioning an arm 52' extending from a base member 51' to or within a support member bracket 38'. Coupling each support member 50' may also include adjusting, for example, slidably, the wall support member 80' and securing the wall support member 80' to a base member 51'. Coupling each support member 50' may further include securing a form stop 85' (e.g., slidably along the base member 51' within the wall space 60') to the inner side of the wall panel 44' opposite the wall support lip 84'.

It should be understood by those skilled in the art that while positioning the outer and inner form panels 30', 40' have been described prior to coupling the support members 50', the above-described operations may be performed in another order. For example, the support members 50' may be partially coupled prior to positioning the inner form panels 40'. More particularly, each support member 50' may initially be coupled so that the arm 52' may be coupled to the support member bracket 38'. The inner form panels 40' may then be positioned in side-by-side relation by coupling respective wall support lips 84' to corresponding inner form panels (e.g., a longitudinal support rib 45'). For example, a single inner form panel 40' may be hung from one or more of the corresponding wall support lips 84', followed by an adjacent inner form panel, and so on. Operations end at Block 128'.

Figure 21:
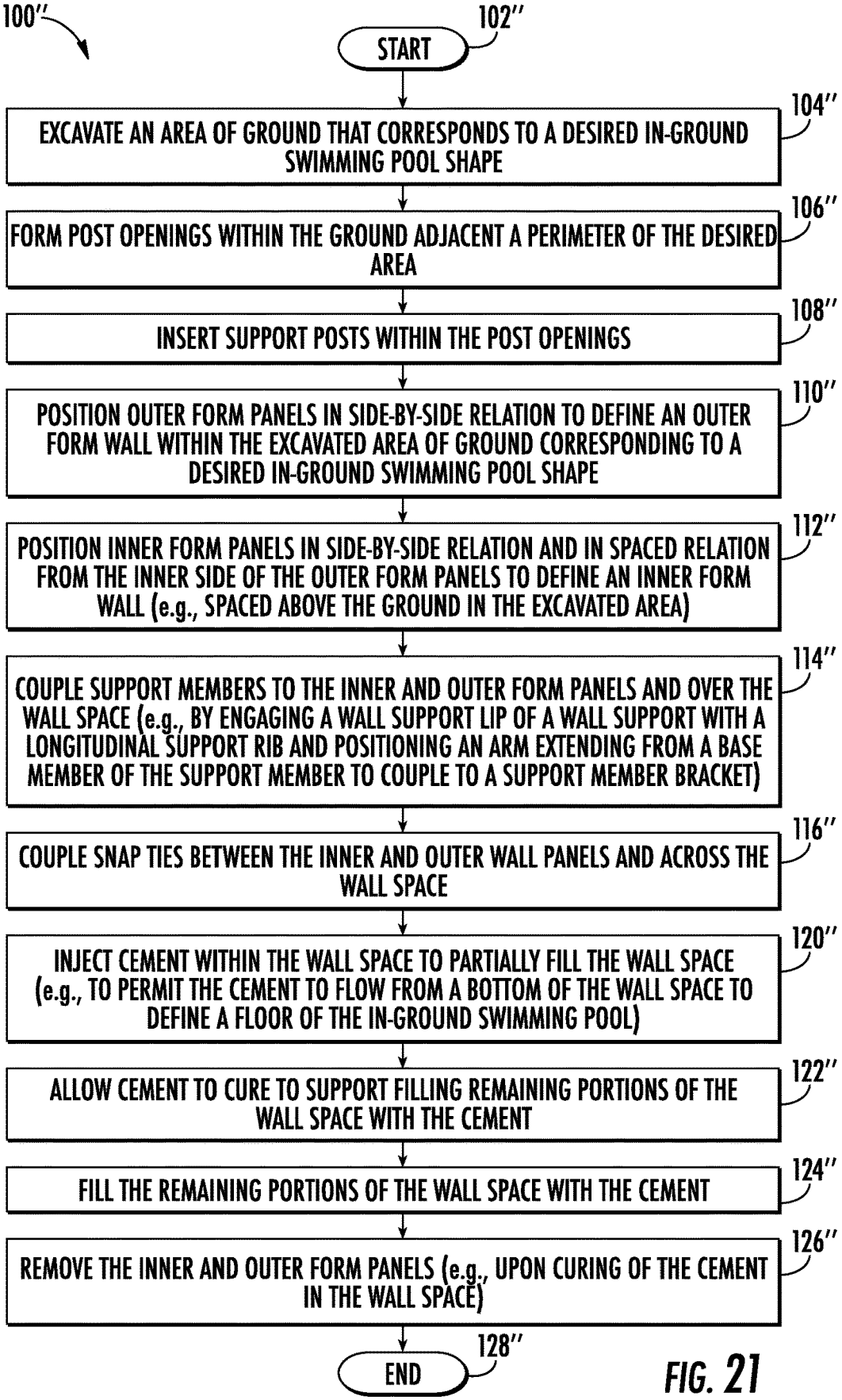
FIG. 21 is another flow diagram of a method of constructing an in-ground swimming pool.

Referring now to the flowchart 100" in FIG. 21, beginning at Block 102", another embodiment of a method of constructing an in-ground swimming pool 20" is described. At Block 104", the method includes excavating an area of ground 22" that corresponds to a desired in-ground swimming pool shape. The depth of the excavated area of ground 22" may correspond to a desired depth of the in-ground swimming pool. For example, a spa or sun-shelf may have a more shallow excavated depth, while a "deep-end" may have a corresponding deeper excavated depth. Those skilled in the art will appreciate that similar to the excavated area or plan, the depth may be excavated to be slightly deeper than the desired depths, for example, to permit plumbing, rebar, and/or other in-ground swimming pool components within the excavated area.

At Block 106", the method includes forming post openings within the ground 22" adjacent a perimeter of the desired area and inserting support posts 23" (e.g., vertically) within the post openings (Block 108"). As will be appreciated by those skilled in the art, the area of ground 22" is excavated to be slightly larger than the desired size of the in-ground swimming pools so as to permit the support posts 23" to be positioned therein.

The method further includes positioning outer form panels 30" in side-by-side relation to define the outer form wall 31" (Block 110"). At Block 112", inner form panels 40" are positioned in side-by-side relation and in spaced relation (i.e., spaced apart) from the inner side 36" of the outer form walls 31" to define the inner form wall 41".

The method further includes, at Block 114", coupling the support members 50" to the inner and outer form panels 40", 30" and over the wall space 60", for example, to maintain the wall space or the inner and outer wall panels in spaced relation. More particularly, the support members 50' are coupled by engaging a wall support lip 84" of a wall support member 80" with the longitudinal support rib 45", for example, an uppermost longitudinal support rib, of the inner form panel 40". More particularly, coupling each support member 50" may include coupling or positioning an arm 52" extending from a base member 51" to or within a support member bracket 38'. Coupling each support member 50" may also include adjusting, for example, slidably, the wall support member 80" and securing the wall support member to a base member 51". Coupling each support member 50" may further include securing a form stop 85" (e.g., slidably along the base member 51" within the wall space 60") to the inner side of the wall panel 44" opposite the wall support lip 84".

The method also includes, at Block 116", coupling snap ties 88" between the inner and outer wall panels 40", 30' and across the wall space 60" adjacent the lower end of the inner and outer wall panels and adjacent the excavated ground 22".

At Block 120", cement, for example, concrete, is injected within the wall space 60" to partially fill the wall space. The cement, which may be sourced from a ready-mix truck, may not be sprayed, such as, for example, gunite, shotcrete, or sprayed concrete. The cement, which may be poured in the wall space 60", may be 2000-6000 psi concrete, and more particularly 4000 psi concrete. The cement is injected to partially fill the wall space 60". More particularly, the cement is injected from the top of the wall space 60" or adjacent the top of the inner and outer form walls 31", 41". As the cement is injected, it falls within the wall space 60" and, because of the spacing of the inner and outer form walls 31", 41" from the ground 22" in the excavated area, the cement will flow from the bottom of the wall space to what will be the floor of the in-ground swimming pool, for example, since the inner form walls 31" are shorter than the outer form walls 41". Those skilled in the art will appreciate that the cement may be vibrated, for example, by hitting the inner form wall 41" with a mallet or hammer to facilitate its flow. As the cement flows, it can be troweled and curved to define a floor-to-wall transition. As the floor-to-wall transition is being formed or troweled, the cement is curing. Cement is permitted to partially, and not fully, fill the wall space 60".

After a sufficient curing time for the partially filled wall space 60", for example, 30-minutes (Block 122"), remaining portions of the wall space 60" are filled with cement (Block 124"). While 30-minutes is an exemplary curing time, it should be appreciated by those skilled in the art that the curing time may be different, for example, a sufficient curing time so as to support the weight of the cement after filling the remaining portions of the wall space 60".

At Block 126", upon curing of the remaining portions of the cement, the inner and outer form panels 30", 40" are removed exposing cement walls of the in-ground swimming pool 20", the inner side to be facing pool water and the outer side to be facing the ground. The space between the outer side of the cement pool wall and the excavated ground may be backfilled to remove that space. The method ends at Block 128".

It should be understood by those skilled in the art that while several embodiments have been described herein, any one or more elements from any one or more embodiments may be included with another embodiment. Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A form system for an in-ground swimming pool comprising:

a plurality of outer form panels to be coupled in side-by-side relation within an area of excavated ground corresponding to a desired in-ground swimming pool shape;

a plurality of inner form panels to be coupled in side-by-side relation; and a plurality of support members to couple said plurality of outer form panels in spaced relation from said plurality of inner form panels to define a wall space therebetween, each of said plurality of support members comprising a base member to be carried by respective ones of said outer and inner form panels over the wall space, an arm extending from said base member for coupling to the respective outer form panel, and a wall support member for coupling to the respective inner form panel and comprising a wall support body carried by said base member and a wall support lip extending from said wall support body, said wall support lip for engaging the respective inner form panel so that the respective inner form panel is suspended from said wall support lip;

at least one support member of the plurality thereof further comprising a sleeve coupled to said base member between said wall support member and said arm for engaging the respective inner form panel within the wall space.

2. The form system of claim 1 wherein each of said plurality of outer form panels comprises a wall panel and a support member bracket carried by the wall panel and configured to couple to a respective arm.

3. The form system of claim 2 wherein said support member bracket has a passageway therein to slidably receive said arm.

4. The form system of claim 1 wherein each of said plurality of inner form panels comprises a wall panel and at least one longitudinal rib carried by said wall panel for engaging said wall support lip.

5. The form system of claim 4 wherein said at least one longitudinal rib is carried by an upper end of said wall panel adjacent said support member.

6. The form system of claim 1 wherein said sleeve is slidable along said base member.

7. The form system of claim 1 wherein said wall support member is movable along said base member.

8. The form system of claim 1 wherein said plurality of inner form panels have a height that is shorter than a height of said plurality of outer form panels.

9. The form system of claim 1 wherein said wall support lip extends from said wall support member for engaging the respective inner form panel adjacent an upper end thereof; and further comprising a plurality of snap ties to extend across the wall space and couple said plurality of inner and outer form panels.

10. A support member for a form system for an in-ground swimming pool, the form system comprising a plurality of outer form panels to be coupled in side-by-side relation within an area of excavated ground corresponding to a desired in-ground swimming pool shape and a plurality of inner form panels to be coupled in side-by-side relation, the support member comprising:

a base member to be carried by respective outer and inner form panels over a wall space defined therebetween;

an arm extending from said base member for coupling to the respective outer form panel;

a wall support member for coupling to the respective inner form panel and comprising a wall support body carried by said base member and a wall support lip extending from said wall support body, said wall support lip for engaging the respective inner form panel so that the respective inner form panel is suspended from said wall support lip; and a sleeve coupled to said base member between said wall support member and said arm for engaging the respective inner form panel within the wall space.

11. The support member of claim 10 wherein said sleeve is slidable along said base member.

12. A method of constructing an in-ground swimming pool comprising:

positioning a plurality of outer form panels in side-by-side relation within an excavated area of ground corresponding to a desired in-ground swimming pool shape;

positioning a plurality of inner form panels in side-by-side relation; and coupling a plurality of support members to the plurality of outer form panels in spaced relation from the plurality of inner form panels to define a wall space therebetween;

each of the plurality of support members being coupled so that a base member thereof is carried by respective ones of the outer and inner form panels over the wall space, so that an arm thereof extends from the base member and couples to the respective outer form panel, and so that a wall support lip extending from a support member body carried by the base member, engages the respective inner form panel to suspend the respective inner form panel from the wall support lip;

at least one support member of the plurality thereof further being coupled so that a sleeve thereof coupled to the base member between the wall support member and the arm engages the respective inner form panel within the wall space.

13. The method of claim 12 wherein each of the plurality of outer form panels comprises a wall panel and a support member bracket carried by the wall panel; and wherein coupling each of the plurality of support members comprises coupling the arm to a corresponding support member bracket.

14. The method of claim 13 wherein coupling the arm comprises slidably positioning the respective arm within a passageway within the support member bracket.

15. The method of claim 12 wherein positioning the sleeve comprises slidably moving the sleeve along the base member.

16. The method of claim 12 further comprising coupling a plurality of snap ties between the plurality of inner and outer form panels and across the wall space.

17. A method of constructing an in-ground swimming pool comprising:

coupling a plurality of support members to a plurality of outer form panels in spaced relation from a plurality of inner form panels defining a wall space therebetween, the plurality of outer form panels being within an area of excavated ground corresponding to a desired in-ground swimming pool shape;

each of the plurality of support members being coupled so that a base member thereof is carried by respective ones of the outer and inner form panels over the wall space, so that an arm thereof extends from the base member and couples to the respective outer form panel, and so that a wall support lip extending from a wall support body carried by the base member engages the respective inner form panel to suspend the respective inner form panel from the wall support lip;

at least one of the plurality of support members being coupled so that a form stop of the at least one support member is positioned to accommodate a width of a corresponding one of the plurality of inner form panels.

18. The method of claim 17 wherein each of the plurality of outer form panels comprises a wall panel and a support member bracket carried by the wall panel; and wherein coupling each of the plurality of support members comprises coupling the arm to a corresponding support member bracket.

19. The method of claim 18 wherein coupling the arm comprises slidably positioning the respective arm within a passageway within the support member bracket.

20. The method of claim 17 further comprising coupling a plurality of snap ties between the plurality of inner and outer form panels and across the wall space.

* * * * *